US011199370B1

(12) United States Patent
Sugg

(10) Patent No.: US 11,199,370 B1
(45) Date of Patent: Dec. 14, 2021

(54) FIREARM, BOLT CATCH, AND LOWER RECEIVER

(71) Applicant: Edward Sugg, South Riding, VA (US)

(72) Inventor: Edward Sugg, South Riding, VA (US)

( * ) Notice: Subject to any disclaimer, the term of this patent is extended or adjusted under 35 U.S.C. 154(b) by 0 days.

(21) Appl. No.: 16/989,765

(22) Filed: Aug. 10, 2020

Related U.S. Application Data

(63) Continuation-in-part of application No. 16/735,377, filed on Jan. 6, 2020, now Pat. No. 10,982,916, which
(Continued)

(51) Int. Cl.
*F41A 3/26* (2006.01)
*F41A 5/26* (2006.01)
*F41A 3/66* (2006.01)

(52) U.S. Cl.
CPC ..... *F41A 3/26* (2013.01); *F41A 3/66* (2013.01); *F41A 5/26* (2013.01)

(58) Field of Classification Search
CPC ..... F41A 3/26; F41A 3/68; F41A 17/36
See application file for complete search history.

(56) References Cited

U.S. PATENT DOCUMENTS

D258,139 S 2/1981 Behlert
D652,468 S 1/2012 Burt et al.
(Continued)

FOREIGN PATENT DOCUMENTS

CA 2982233 A1 12/2016
CA 2962313 A1 9/2017
WO WO 2017/106857 A1 6/2017

OTHER PUBLICATIONS

Anderson Manufacturing AR-15 Stripped Lower Receiver, posted at Primary Arms, reviewed Jul. 8, 2015, site visited Sep. 25, 2019. URL: <https://www.primaryarms.com/anderson-manufacturing-ar-15-stripped-lower-receiver?page=9> (4 Pages Total), (Year: 2015).
(Continued)

*Primary Examiner* — J. Woodrow Eldred
(74) *Attorney, Agent, or Firm* — Arent Fox LLP

(57) ABSTRACT

A firearm with a lower receiver and bolt catch. The lower receiver may include a first external wall portion that is on the left side of the firearm and a second external wall portion on the right side of the firearm when a front of the lower receiver is facing forward, the rear of lower receiver is facing rearward, the bottom of the lower receiver is facing downward, and the firearm is in a firing position. The firearm may further include a bolt catch for preventing forward movement of the bolt. The bolt catch may include a first external bolt catch portion that exits the first external wall portion of the receiver on the left side of the firearm and a second external bolt catch portion that exits the second external wall portion of the receiver on the right side of the firearm. The bolt catch may further include an internal bolt catch portion within the lower receiver that connects the first external bolt catch portion and the second external bolt catch portion, wherein at least a first portion of the internal bolt catch portion extends in at least one of a rearward direction towards the rear of the receiver, or a downward direction towards the bottom of the lower receiver.

19 Claims, 18 Drawing Sheets

Related U.S. Application Data is a continuation of application No. 16/215,207, filed on Dec. 10, 2018, now Pat. No. 10,545,003, which is a continuation-in-part of application No. 16/032,008, filed on Jul. 10, 2018, now Pat. No. 11,035,632, and a continuation-in-part of application No. 29/634,489, filed on Jan. 22, 2018, now Pat. No. Des. 892,961, and a continuation-in-part of application No. 29/634,488, filed on Jan. 22, 2018, now Pat. No. Des. 918,329, and a continuation-in-part of application No. 15/732,225, filed on Oct. 6, 2017, now abandoned, which is a continuation of application No. 15/248,525, filed on Aug. 26, 2016, now Pat. No. 10,151,544.

(60) Provisional application No. 62/411,538, filed on Oct. 22, 2016, provisional application No. 62/405,195, filed on Oct. 6, 2016, provisional application No. 62/366,110, filed on Jul. 24, 2016, provisional application No. 62/342,460, filed on May 27, 2016, provisional application No. 62/326,762, filed on Apr. 24, 2016, provisional application No. 62/325,991, filed on Apr. 21, 2016, provisional application No. 62/320,432, filed on Apr. 8, 2016, provisional application No. 62/311,874, filed on Mar. 22, 2016, provisional application No. 62/310,486, filed on Mar. 18, 2016, provisional application No. 62/279,887, filed on Jan. 18, 2016, provisional application No. 62/245,834, filed on Oct. 23, 2015, provisional application No. 62/210,278, filed on Aug. 26, 2015.

(56) References Cited

U.S. PATENT DOCUMENTS

| | | | |
|---|---|---|---|
| D713,485 | S | 9/2014 | Firpo, I et al. |
| D726,863 | S | 4/2015 | Crume, Sr. |
| 9,009,986 | B1 | 4/2015 | Chang et al. |
| 9,121,652 | B1 | 9/2015 | Mangiameli |
| D746,936 | S | 1/2016 | Huang |
| D755,338 | S | 5/2016 | Slank |
| D760,862 | S | 7/2016 | Wang |
| D764,005 | S | 8/2016 | Neil |
| D773,585 | S | 12/2016 | Miller, III |
| 9,541,339 | B2 | 1/2017 | Orne, III et al. |
| D782,596 | S | 3/2017 | Angstadt et al. |
| D784,478 | S | 4/2017 | Therrell |
| 9,651,328 | B1 | 5/2017 | Oglesby |
| D796,619 | S | 9/2017 | Morris |
| D797,878 | S | 9/2017 | Wang |
| D805,154 | S | 12/2017 | Steele et al. |
| D805,155 | S | 12/2017 | Geissele |
| 9,909,828 | B1 | 3/2018 | Klein et al. |
| D816,180 | S | 4/2018 | Farris et al. |
| 10,030,924 | B1 | 7/2018 | Smith |
| D833,563 | S | 11/2018 | Snively |
| D835,225 | S | 12/2018 | Podgurny |
| D837,924 | S | 1/2019 | Kunau |
| 10,180,298 | B2 | 1/2019 | Noonan |
| 10,234,226 | B1 | 3/2019 | Copeland |
| D849,175 | S | 5/2019 | Willits |
| D859,567 | S | 9/2019 | Geissele |
| D859,568 | S | 9/2019 | Geissele |
| D859,569 | S | 9/2019 | Geissele |
| D876,576 | S | 2/2020 | Gerlings |
| D877,282 | S | 3/2020 | Gerlings |
| 2010/0251591 | A1 | 10/2010 | Burt et al. |
| 2010/0275485 | A1 | 11/2010 | Findlay |
| 2011/0056107 | A1 | 3/2011 | Underwood |
| 2011/0283580 | A1 | 11/2011 | Esch |
| 2012/0297656 | A1 | 11/2012 | Langevin et al. |
| 2013/0227869 | A1 | 9/2013 | Thordsen |
| 2015/0000171 | A1 | 1/2015 | Roberts |
| 2015/0101230 | A1 | 4/2015 | Curtis |
| 2015/0354912 | A1 | 12/2015 | Miller, III |
| 2016/0076842 | A1 | 3/2016 | Faxon |
| 2016/0084601 | A1 | 3/2016 | Alicea, Jr. |
| 2016/0169601 | A1 | 6/2016 | Newman |
| 2016/0209136 | A1 | 7/2016 | Schuetz |
| 2016/0258696 | A1 | 9/2016 | Fluhr et al. |
| 2016/0258697 | A1 | 9/2016 | Hoon |
| 2016/0258713 | A1 | 9/2016 | Huang et al. |
| 2016/0273857 | A1 | 9/2016 | Pettit et al. |
| 2017/0045324 | A1 | 2/2017 | Zeman |
| 2017/0160026 | A1 | 6/2017 | Walther et al. |
| 2017/0160032 | A1 | 6/2017 | Overstreet et al. |
| 2017/0227309 | A1 | 8/2017 | Faxon |
| 2017/0241729 | A1 | 8/2017 | Gangl et al. |
| 2017/0284761 | A1* | 10/2017 | Lewis ..... F41A 17/36 |
| 2017/0299292 | A1 | 10/2017 | Daley, Jr. |
| 2017/0356706 | A1 | 12/2017 | Beaty |
| 2018/0087854 | A1 | 3/2018 | Gray |
| 2018/0100712 | A1 | 4/2018 | Tompkins |
| 2018/0100714 | A1 | 4/2018 | Borders |
| 2018/0266778 | A1 | 9/2018 | Noonan et al. |
| 2018/0321005 | A1 | 11/2018 | Quinn et al. |
| 2019/0041146 | A1 | 2/2019 | Johnson, Jr. |
| 2020/0182571 | A1* | 6/2020 | Noonan ..... F41A 17/36 |
| 2021/0180900 | A1* | 6/2021 | Markut ..... F41A 3/72 |

OTHER PUBLICATIONS

Teal Blue Bravo PDQ Ambi-Bolt Release for Aero Precision Ambi Lowers, posted at Primary Arms, reviewed Aug. 17, 2016. Site visited Sep. 25, 2019. URL: <https://www.primaryarms.com/teal-blue-bravo-pdq-ambi-bolt-release-for-aero-precision-ambi-lowers-aprh100012> (3 Pages Total), (Year: 2016).

* cited by examiner

FIREARM, BOLT CATCH, AND LOWER RECEIVER

CROSS-REFERENCE TO RELATED APPLICATIONS

This Application for Patent is a Continuation in Part of U.S. patent application Ser. No. 16/735,377 titled "FIREARM AND FIREARM BOLT CARRIER GROUP ASSEMBLY", filed on Jan. 6, 2020, which is a Continuation of U.S. patent application Ser. No. 16/215,207, titled "SYSTEMS AND COMPONENTS FOR IMPROVING FIREARM OPERATION, AS WELL AS DEFENSIVE SYSTEMS AND TARGET ACQUISITION", filed on Dec. 10, 2018, which is a continuation of U.S. application Ser. No. 15/248,525, titled "SYSTEMS AND COMPONENTS FOR IMPROVING FIREARM OPERATION, AS WELL AS DEFENSIVE SYSTEMS AND TARGET ACQUISITION", filed on Aug. 26, 2016, which claims priority to U.S. Provisional Patent Application No. 62/366,110, which was filed on Jul. 24, 2016, U.S. Provisional Patent Application No. 62/342,460, which was filed on May 27, 2016, U.S. Provisional Patent Application No. 62/326,762, which was filed on Apr. 24, 2016, U.S. Provisional Patent Application No. 62/325,991, which was filed on Apr. 21, 2016, U.S. Provisional Patent Application No. 62/320,432, which was filed on Apr. 8, 2016, U.S. Provisional Patent Application No. 62/311,874, which was filed on Mar. 22, 2016, U.S. Provisional Patent Application No. 62/310,486, which was filed on Mar. 18, 2016, U.S. Provisional Patent Application No. 62/279,887, which was filed on Jan. 18, 2016, U.S. Provisional Patent Application No. 62/245,834, which was filed on Oct. 23, 2015, and U.S. Provisional Patent Application No. 62/210,278, which was filed on Aug. 26, 2015, the contents of each of which are incorporated herein by reference in their entirety.

This Application for Patent is also a Continuation in Part of U.S. patent application Ser. No. 16/032,008, titled "CAM PATH APPARATUS AND USES THEREOF", filed on Jul. 10, 2018, which in turn is a Continuation in Part of U.S. application Ser. No. 15/732,225, titled "OPERATING SYSTEM IMPROVEMENTS", which was filed on Oct. 6, 2017, which in turn claims priority to U.S. Provisional Application No. 62/405,195 filed Oct. 6, 2016, and U.S. Provisional Patent Application No. 62/411,538 filed Oct. 22, 2016. the contents of each of which are incorporated herein by reference in their entirety.

This Application for Patent is also a Continuation in Part of U.S. Design application No. 29/634,489, Titled "AMBIDEXTROUS BOLT CATCH", filed on Jan. 22, 2018 and a Continuation in Part of U.S. Design application No. 29/634,488, Titled "LOWER RECEIVER", filed on Jan. 22, 2018, the contents of each of which are incorporated herein by reference in their entirety.

FIELD OF THE INVENTION

Aspects of the present invention relate generally to firearms and defensive systems and, more particularly to automatic and semi-automatic firearms and weapons both individual, crew served and otherwise, and still more particularly and without limitation to semi-automatic rifles such as, but not limited to, for example the AK-47 or similar or equivalent or to the "AR-10" and "AR-15" ("AR" standing for "ArmaLite Rifle"), and their automatic brethren (e.g., M-16), and other similar derivatives such as the HK416 and other "piston operated" firearms collectively referred to herein as the "Stoner" Family of Weapons ("FOW") in view of the general architecture and operation of the inventor of these particular firearms systems, Eugene Stoner.

BACKGROUND OF THE INVENTION

The basic mechanical structure of the Stoner FOW is used by way of example to illustrate the inventive concepts disclosed herein, which are representative of the applicability of these inventive concepts to other firearms systems and firearms platforms, but such inventive concepts are not to be taken to be limited to the Stoner FOW.

FIG. 1 shows an exploded view of a conventional AR-15, which serves as an example of a firearm to which aspects of the inventive improvements disclosed herein may be applied. FIG. 1 shows, among other elements, a buttstock 12, a lower receiver 14, a handle 16, a magazine well 18, a magazine 20, a trigger 22, a barrel 24, a bolt carrier 26, a bolt 28, a firing pin 30, a charging handle 32, an upper receiver 34, a gas tube 36, a bolt catch 38, a sight 40, gas rings 42, a magazine catch 44, and a magazine release button 46.

During operation of a direct impingent type firearm, such as the AR-15 shown in FIG. 1, gas travels down the gas tube 36 located above the barrel 24. The gas tube 36 is operatively connected to a bolt carrier key 48, allowing the gas from the gas tube 36 to pass into the bolt carrier 26. The bolt 28 and bolt carrier 26 together act as a piston (bolt 28) and cylinder (bolt cavity or recess within carrier body), which moves as the bolt carrier 26 cavity is filled with gas which pushes the bolt and carrier body apart via expansion of gasses. The bolt 28 is incapable of rearward movement when it is locked to barrel extension 50. It unlocks from the extension via rotation of the bolt controlled by the cam path or slot and the movement of the cam pin 52 within the cam path which controls rotational movement or turning of the bolt. This impacts both the movement out of battery ("unlocking") and movement into battery ("locking"). Therefore, when the bolt carrier 26 is filled with gas, the bolt carrier 26 is forced backward by interaction of the expanding gasses creating movement between the bolt 28 and bolt recess within the carrier body—which are kept together by the cam pin moving within the cam path, toward the buttstock 12.

FIG. 2 shows the conventional bolt 28 in more detail, depicting the main body 80, rectangular lugs 68 disposed at the front end of the bolt 28 (i.e., the end closer to the barrel 24 when assembled in a firearm), ribs 78 adjacent to the lugs 68, a tail portion 70 disposed at the rear end of the bolt 28 (i.e., the end farther from the barrel 24 when assembled), a gas ring 42 adjacent to the tail portion 70, a decreased diameter portion 72 adjacent to the gas ring 42, a through hole 74 adjacent to the decreased diameter portion 72, a wear ring 76 disposed between the through hole 74 and the lugs 66.

A cam pin 52, riding in a slot on the bolt carrier 26, forces the bolt 28 to turn and unlock from the barrel extension 50. Once the bolt 28 is unlocked, the bolt 28 moves rearward along with the bolt carrier 26. The rearward motion of the bolt 28 extracts an empty cartridge case from the chamber, and a spring-loaded ejector 54 forces the cartridge out the ejection port 56. Behind the bolt carrier is an in-line buffer 58 with an action or buffer spring 60 that pushes the bolt carrier 26 back toward the chamber. A groove of the upper receiver guides the cam pin 52 and prevents it and the bolt 28 from rotating into a closed position. The locking lugs of the bolt 28 then push a fresh round from the magazine as the bolt moves forward. As the bolt's locking lugs move past the barrel extension, the cam pin 52 twists into a pocket milled into the upper receiver, following the groove cut into the carrier, and forces the bolt to twist and "lock" into battery the barrel extension.

While the Stoner FOW has been known in the public for well over 50 years (see, e.g., U.S. Pat. No. 2,951,424, titled "Gas Operated Bolt and Carrier System," published Sep. 6, 1960, incorporated by reference herein in its entirety), and has been oft-modified in such time, there remains room for further improvements.

SUMMARY OF THE INVENTION

Aspects of the present invention provide, among other things, improvements on various elements of a firearm, including a barrel gas port, gas key, cam pin, cam pin slot or cam path, bolt, bolt catch, bolt carrier, barrel extension, bolt carrier gas port, gas entry hole in the carrier, carrier to upper receiver clearance, buffer, buffer tube, charging handle, barrel profile, hammer, and piston, any one or more of which may be utilized singly or in any combination, to improve at least some aspects of firearm performance.

As noted above, the basic mechanical structure of the Stoner FOW is used by way of example to illustrate the inventive concepts disclosed herein, which are representative of the applicability of these inventive concepts to other firearms systems and firearms platforms, but such inventive concepts are not to be taken to be limited to the Stoner FOW. The concepts disclosed herein apply to both Direct Impingement ("DI") and Piston firearms, as well as to any caliber. All figures should be viewed as both absolutes, subject to acceptable tolerances, and also as percentages in the case of different sized firearms that may be developed or in use from this series of firearms.

The Stoner FOW are very popular, very widely used, and have a reputation for durability. However, they suffer from a question of reliability at times, especially in adverse circumstances with dirt, debris, firing fouling, heat, and/or poor lubrication or even no lubrication. In operation, there is a significant amount of metal-to-metal surface contact, subject to friction or fouling, that can create an undue amount of resistance. This is significant because among other reasons, of the short but broad contact surfaces within the action. As observed by the present inventor, the operating parts lack stability but create unnecessary friction or "drag" in operation, due to relatively short contact surfaces and often excessive clearance, and simultaneously suffer from a fairly "wide" contact area in routine operation. To overcome the known envelope of frictional resistance, the firearms are typically "overgassed", or given excessive amounts of gas power to operate the actions. This leads to excessive fouling of the firearm, which creates a need to drive yet more energy or gas to overcome the fouling induced friction creating a vicious cycle, and also adversely affects component durability and increases operator fatigue relative to the cartridge involved. These adverse effects arise in part because the bolt/carrier velocity is excessive, owing to the overgassing, which imparts correspondingly higher impulse forces that accelerate component wear and breakage and that negatively impact accessories such as optics or electrical devices (e.g. lights, night vision or thermal devices, etc.). Reducing the "frontal area" or effectively the width of the frictional contact surfaces when compared to their current cross sectional area in current TDP dimensions is a critical aspect of the invention. This is a critical attribute of creating a less frictional or "low drag" operating system. This can be further improved by increasing the effective length, or "aspect ratio", as disclosed to even further improve performance.

In short there is quite a bit of gas "input" to overcome high resistance from contact surfaces (friction) that is made worse by dirt, fouling, or poor lubrication.

There is relatively little room for the cycling of the firearm, or stroke, to deal with or accommodate excessive bolt/carrier velocity caused by overgassing. This can lead to trying to solve this problem of excess input energy by "over springing" (too heavy of a spring) or "over buffering" (too heavy of a buffer) the firearm, which can lead to short stroking (i.e., where the firearm will not fully cycle) or excess wear and parts breakage. Increasing stroke capacity or length is key to improving operation of the gun.

The movement of the bolt face, past the cartridge rim, at its maximum rearward travel point is about 0.600" at most, and is typically less than this with as little as 0.025"-0.100" movement with the current system. This movement is typically a maximum of 0.125"-0.130" past the back edge of the bolt catch 110 in FIG. 2. This offers very little energy for feeding of subsequent cartridges or margin for operation. It may also cause "failure to lock" malfunctions which cause the bolt catch 110 to not activate which in turn prevents the bolt 38 and bolt carrier 115 to not "lock" open upon the last round being fired from the magazine, which is the intended method of operation. In accord with at least some aspects of the present concepts, the disclosure herein shows how this distance can be increased by 70% or more, with movement increase past the bolt catch of over 4× possible which has been determined by the inventor to provide much more stable, controllable operation and to provide more time for the magazine to feed the next cartridge.

This same issue, the lack of room for rearward movement or stroke, also causes recoil forces to be distributed over a relatively small space and time. This fact, coupled with fast and sub optimally violent bolt "unlocking" from the barrel extension makes the firearm operate in a much faster and more violent manner than optimal.

The inventive concepts disclosed herein solve the aforementioned issues by increasing the stroke length, which has been determined by the inventor to reduce the excess input forces via over gassing coupled with inadequate space to dissipate input movement forces or recoil caused by high bolt and bolt carrier velocity. With this modification, coupled with the improved cam path 120 in FIGS. 3C and 7D in which the bolt 38 locks and unlocks more gradually, over a longer period of time. This dramatically reduces the forces applied to the firearm, especially the bolt "lugs" 68 which are often prone to breakage. The bolt 38 stays locked longer prior to unlocking, which makes extraction of the spent casing easier and less violent since the gas pressure within the case drops during this time. Yet further, at least some aspects of the present concepts reduce fouling and the exposure to operators of acrid exhaust gas due to less pressurized gas exiting the chamber and bore into the action. It is to be noted that the extended stroke disclosed herein is separate from the modified cam path 120, disclosed below, which drives the less violent unlocking/locking of the bolt, and also keeps the bolt locked for a longer period of time which reduce pressure on the empty cartridge for easier extraction and result in less fouling being blown into the action. The extended stroke and the modified cam path 120 may be used separately or more optimally they may be combined as well.

Still further, other aspects of the present concepts disclosed herein increase stability of the critical operating parts of the firearm, while simultaneously dramatically reducing friction and susceptibility to dirt and fouling friction.

In at least some aspects of the present concepts, the cam path 120 extends the "unlocking" (extraction and movement of the bolt out of battery) and the "locking" (feeding and movement of the bolt into battery) by at least 1% compared to TDP dimensions, and preferably 1-5%, even more preferably 4-15%, and most preferably 14-30% or more within the existing cam path length. Further gains may be accomplished with extension of this length by changing the length of the center of the Cam Pin 205 FIG. 4C to the front of the Carrier 115 to less than 0.640" as called for in the TDP. This may be reduced by 0.002-0.015", preferably 0.010-0.020", and even more preferably by 0.020-0.040". These changes will cause a commensurate amount of length or space in the Cam Path 120 as well as the delay in "unlocking" action of the Bolt The "locking" cam surface and the "unlocking" cam surface may be parallel, as is the case currently, or they may be arrayed in an asymmetric manner wherein one of the cam surfaces flares away or narrows towards the other cam surface. The angles or edges of the cam surface as it transitions into the "dwell" area—whether the "locked" or "unlocked" dwell may be more aggressively radiused than called for in the TDP. This is in order to provide the smoothest possible transition between the camming surface and the "dwell" areas, which reduces the wear and tear on the gun and parts and also provides a smoother firing cycle to the shooter. The entire Cam Path may a smooth, continuous path with minimal transition, as compared to TDP, between locked and unlocked "dwell" areas or the locking or unlocking Cam surfaces.

In at least some aspects of the present concepts, the cam path angle or curvature so that the "unlocking" and "locking" surfaces are less transverse to the direction of travel of the carrier, and more parallel to it, as compared to TDP dimensions and extant art. This ensures less violent unlocking and more reliable feeding. The reduction of the "dwell" provided at the ends of the Cam Path, and the use of this space for locking and unlocking camming action will support this change—as will the extension of the length of the space available for the entire Cam Path by moving the 0.640" position described above. The 0.640" position may be moved forward as indicated previously but restated here by 0.005-0.010" or more, or preferably 0.010-0.020" or more, or even more preferably by 0.020-0.035" or more, or most preferably by 0.030-0.050" or more.

Furthermore, the Cam Path FIG. 7E is improved at the maximum "unlocking" point by either reducing the size of the "dwell" cutout or pocket versus TDP or other dimensions or more preferably eliminating it entirely. This provides the maximum "unlocking" distance while providing the smoothest locking and unlocking of the Bolt. Effectively the entire Cam Path in this area becomes a continuous and gradual surface which eases both feeding (locking) and extraction (unlocking) when these changes are applied properly to the Cam Path. The Cam Path can also use these changes when "extended", or additional space is provided for Cam movement. With reference to FIG. 7E, the cam slot constrains the cam pin from a bolt to travel along a cam slot path during rotational and translational movement of the bolt, the cam slot defining a first portion 710 for constraining motion of the cam pin and the bolt during engagement or disengagement of the plurality of lugs of the bolt and the corresponding plurality of lugs of the barrel receiver or extension, a second portion 720 for imparting rotational movement to the cam pin and bolt during linear movement of the bolt carrier, and a third portion for constraining motion of the cam pin at an end of a rearward travel of the bolt and bolt carrier during an ejection cycle, wherein the combination of the first portion 710, second portion 720, and the third portion 730 yield an extension of the unlocking by over 10% and a delay of the actual unlock of the bolt by over 5% relative to TDP.

In at least some aspects of the present concepts, the unlocking is started earlier and extended later than TDP and other extant dimensions, within the current TDP length measured from the end to end of the cam path parallel to the carrier body.

Extending the rearward movement (or stroke capacity) of the Bolt Carrier Group (bolt, carrier body, gas key, etc.) rearward by creating a shorter gas key (or equivalent as described herein), and using those changed dimensions to commensurately change the buffer or buffer tube (also known as the receiver extension) wherein stroke is increased by at least 0.390", more preferably 0.390"-0.420", and even more preferably beyond 0.420" to as much as 0.660" or more given redesigned components such as, for example, a hammer. Additionally, a commensurately longer or even shorter in certain cases buffer tube may be used with extant buffers to accomplish the same objective. With changes to other components described herein, such as the hammer and charging handle, etc., as described changes greater than this 0.420" (so greater than 0.420-0.660" or more) are possible and disclosed.

TDP stroke length or capacity is approximately 3.75-3.755" with minor variances possible due to potential tolerance stacking or manufacturing errors.

Additional aspects of the invention will be apparent to those of ordinary skill in the art in view of the detailed description of various embodiments, which is made with reference to the drawings, a brief description of which is provided below.

Figure 1A:
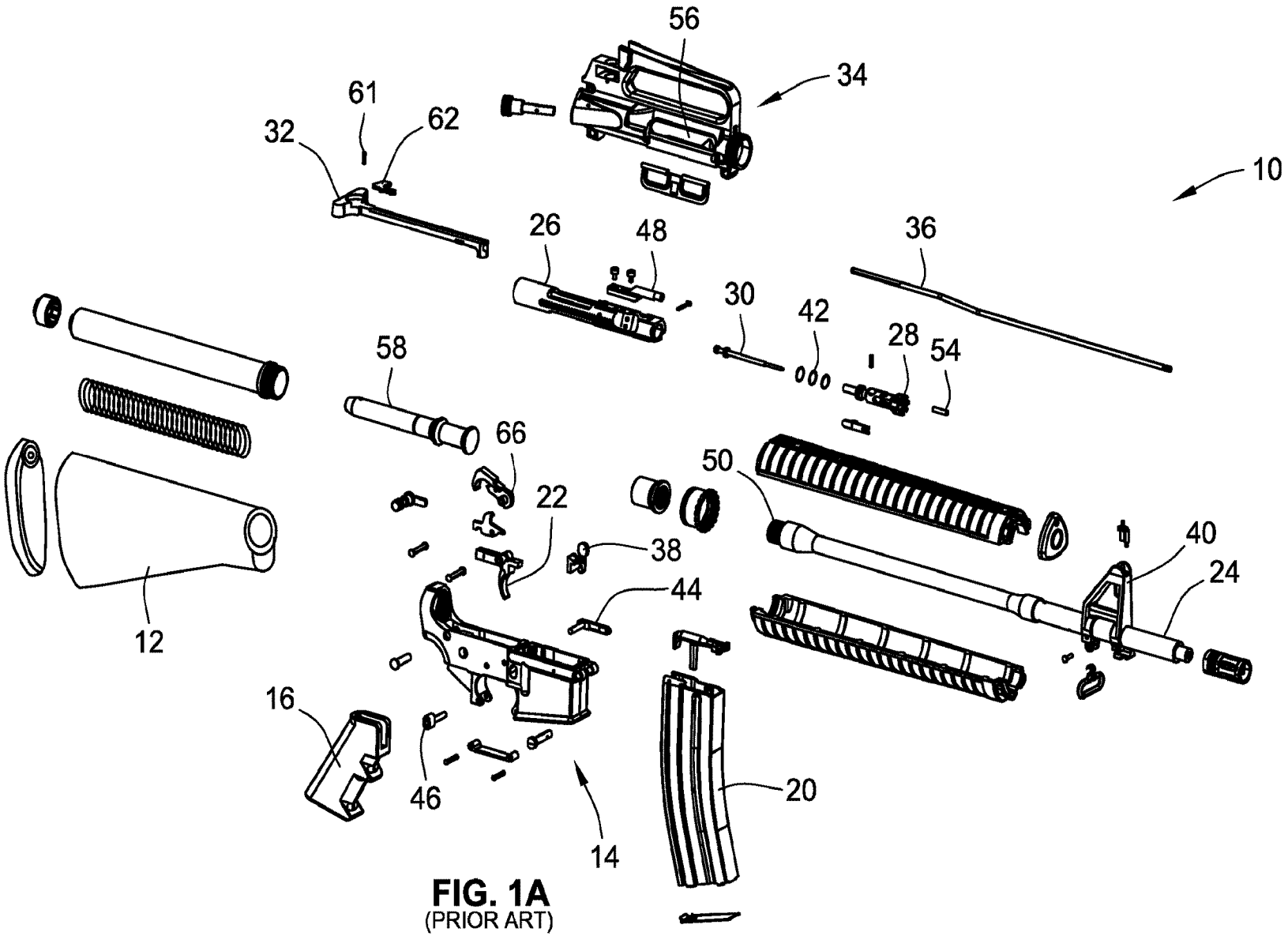
FIG. 1A (PRIOR ART)
FIG. 1A shows an exploded view of a conventional AR-15 firearm.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless contextually illogical or specifically disclaimed); the words "and" and "or" shall be both conjunctive and disjunctive; the word "all" means "any and all"; the word "any" means "any and all"; and the word "including" means "including without limitation."

Gas Port

In at least some aspects of the present concepts, a gas port for 5.56 mm/.223 caliber Stoner pattern AR Direct Impingement carbines is located at a position greater than the conventional "carbine length" position (greater than about 7.8" from bolt face) and less than the conventional "rifle length" position (less than about 13.2" from bolt face) gas systems.

The TDP dimensions for a "rifle length" gas system are a 0.092" gas port, whereas a "carbine length" gas system calls for a 0.070" gas port for the MK18, and a 0.062" gas port for the M4. There is not a TDP dimension for intermediate systems between these, but standard commercial mid length gas ports are 0.076-0.078" or at times larger.

The inventor has determined that, in the current art, gas ports are too large for optimal operation and rate of fire (cyclic rpm), generally speaking but especially when running with a sound suppressor. This "overgassing" is intentionally created for a number of reasons-foremost among these is the high drag of the operating components of the weapon, coupled with the fouling induced friction which is exacerbated by this very same overgassing and fast cycling. The fast cycling, coupled with early unlocking of the Bolt, contribute to even greater friction and parts stress. This creates a "vicious cycle" for the weapon. The suppressor creates additional gas pressure which increases bolt and bolt carrier velocity, as well as unacceptable increases in the rate of fire (rpm). This has been determined to create undue wear and tear on the parts, which leads to premature breakage, and also to create certain problems, such as the firearm "outrunning" the ability of the magazine (feeding device) to properly feed new rounds into the firearm or short stroking of the Bolt Carrier thereby preventing proper feeding. This in turn creates problems such as "bolt over base" failures, which can be catastrophic on the battlefield or in duty use. Automatic AK47 rifles, which are renowned for reliability, have a stated rate of fire of 600 rpm. The M16 when originally introduced had a slower stated rate of fire of approx. 650-700 rpm, but this was sped up by the use of higher pressure ammunition. The higher pressure ammunition was used in order to meet velocity objectives. This led to many parts breakages and reliability issues which were investigated by Congress and chronicled in the "Ichord Report" which included testimony by Eugene Stoner. Other methods to reduce gas flow have included adjustable gas blocks, which can be set to restrict gas flow, but these suffer from the introduction of more moving parts into the operation with many users finding that the gas block is set on the wrong position when in use, which can prevent the gun from cycling or operating properly.

Studies show that NATO spec ammunition (M193 and M855) can run from 800-880 or more rounds per minute (rpm), unsuppressed, even in "mid length" (approx. 9.8" from bolt face) firearms. These will typically use a gas port of 0.076" or 0.078" or larger in diameter. This is done in order to get the firearms to "run reliably". This rate of fire is significantly higher than desirable which creates excessive parts wear, bolt/carrier velocity and a host of other problems. Suppressed fire can increase this by 25%, which is even more undesirable. The rate of fire in common gas port sizes in this class of gas system is higher than published military rates of fire for M4 Carbines (Carbine gas system) and M16 Rifles (Rifle gas system).

In accord with at least some aspects of the present concepts, gas ports are provided in the areas disclosed above (>7.8" and <13.2" from bolt face), but are 0.072" in diameter or smaller, or more preferably 0.070"–0.0719" or less, or even more preferably 0.066"-0.070" or less, or most preferably 0.058"–0.066" or less in diameter. With sufficient reduction in drag of components, this may reduced to 0.040-0.058" or less. The gas ports, although disclosed above as round holes, may utilize other shapes (e.g., oval, rectangular, etc.) in whole or in part, with similar overall areas. These ports may be as small as about 0.025" in diameter. This pertains to AR pattern firearms that use the DI or "direct impingement" operating system. This may also pertain to "piston" operated AR pattern rifles that use a conventional piston system in place of the "DI" or "expanding gas" model. With the lower friction or "low drag" embodiments of the Bolt Carrier Group and Buffer (coupled with the Charging Handle embodiments) as described herein, less input energy or gas will be required to reliably cycle the action. Therefore less gas can be used, which is accomplished by using a smaller gas port in the barrel. This will reduce the rearward bolt/bolt carrier acceleration and thus speed or velocity of the bolt and bolt carrier (BCG) which will lower the rate of fire (cyclic rate in full automatic) or alternately will increase the "cycle time" of the firing operation, or the amount of time to complete a complete cycle of operation in feeding/firing/extraction.

Further to disclosures cited above, the use of gas ports in carbine length systems less than 0.062", and preferably less than 0.050"-0.060", and even more preferably less than 0.035"-0.052" are disclosed. This too is due to the use of low drag components in the action and less overgassing which enable a smaller gas port size. This smaller gas port size can still drive the action without overgassing the system which happens in order to overcome frictional resistance. The dimensions disclosed are different (larger or smaller) than standard dimensions either published or contained in the TDP (Technical Data Package), as applicable. These changes are necessary to achieve optimal performance.

Gas port sizes of less than 0.060" for rifle length systems are disclosed as well, preferably less than 0.050"-0.059", and more preferably less than 0.035"-0.052" are disclosed.

The changes in the gas port sizes disclosed here and elsewhere are to permit the firearm to run effectively and properly without creating an excessive rate of fire. The rate of fire, or cycle time of the gun, is excessive currently especially when guns are suppressed. Excessive rates of fire cause a number of problems including failure to feed, bolt over base malfunctions, etc. These are often the result of the magazine being incapable of keeping up with the cyclic rate of fire. This rate of fire climbs 25% and sometimes more when the gun is fired with a suppressor which generates additional and undesirable back pressure which cause more fouling and makes extraction more difficult. Data from US Navy tests on the MK18 (a 10.3" barrel M4/M16 variant) shows the impact of both suppressed operation as well as the impact of moderate firing fouling on the cyclic rate of fire of the gun. As is disclosed herein, smaller gas ports, enabled by low drag operating components (e.g. BCG), will decrease this rate of fire. Low drag components will decrease the impact of firing fouling thus making the rate of fire between dirty and clean firing rates more consistent. Rates of (unsuppressed) fire greater than 600-700 rpm with normal pressure 5.56 mm NATO loads with a clean, lubricated gun are considered by the present inventor to often be excessive, particularly when operated suppressed, when the rate of fire often climbs 20-30% as compared to unsuppressed firing, and such system is considered to be optimized by the inventor by utilizing less gas input, longer stroke and low drag operating components, taken singly or in combination. Using various techniques disclosed (e.g., long stroke, low drag, inherent gas throttling via smaller gas ports that many in the industry believed would not cycle the gun as well as depressurization ports in the carrier, etc.), tests conducted by the inventor have shown that the 5.56 mm firearm can run reliably and consistently at a rate of fire as low as 500 rpm with further reductions believed possible from the inventor's test results.

This reliability at lower-than-usual rates of fire is enabled by, among others, changes to significantly reduce the friction or drag of the Bolt Carrier Group and associated parts therein, as is described further herein. The reduced friction of the operating parts enables lower gas pressures to be used while still maintaining consistent operation. The lower gas volumes create less gas fouling and less violent cycling of the firearm, creating a "virtuous cycle" of better operation, less fouling, longer firearm and part life, and increased operator comfort and confidence.

Gas Key

In accord with various aspects of the present concepts, disclosed below, modifications of the gas key on the AR Family of Weapons (FOW to include 7.62 mm NATO and other calibers) are made to enhance firearm performance. Most firearms use this pattern, and it will apply to 5.56 mm, 7.62 mm NATO, and many other calibers which use the gas key dimension found in the current TDP (technical data package).

The gas key as described herein may refer to either the gas key or its equivalent with non-Direct Impingement (DI), or piston firearms. The gas key also generally acts as a vertical and otherwise "stabilizer" to keep a carrier or equivalent from "rolling" or otherwise moving out of position within the receiver, in addition to other functions such as accepting gas in a DI firearm or the operating rod (op rod) energy in a piston driven firearm. In order to promote the greatest stability and "roll" resistance, the contact points of the Key may be moved upward from their present position called out in the TDP of 0.182" from the bottom of the Key. In order to decrease drag and friction, contact surfaces on the Key—those that may contact the Receiver or Charging Handle—may be reduced in length, or height, or both. This reduction of contact area, in either case of length or height or in combination, may be from 1-10%, or preferably 9-25%, more preferably from 24-30%, even more preferably from 29-50%, and most preferably from 40-95% or more.

A critical aspect of this component, whether found in DI or piston firearms, is the fact that this component (Gas Key or equivalent, whether detachable or not) is typically the limiting factor in rearward travel of the Bolt Carrier (or equivalent). This distance should be adjusted accordingly with changes to the buffer and or buffer tube. If the key is not the limiting factor, then the buffer or buffer tube (aka receiver extension) is the limiting factor. Barring that, the shortness of the Hammer is a factor to prevent extreme changes in "Stroke", or carrier travel.

Stroke refers to the amount of movement possible to distribute recoil, and the space and time available to dissipate firing energy. As set forth by the present inventor herein, the present concepts seek to maximize stroke to the greatest extent possible so as to reduce the stress transferred to the firearm, firearm parts, optics or other attachments, and the operator.

In accord with one aspect of the present concepts, the length at the rear of the detachable gas key is shortened, from current TDP specs of nominal 2.465" from front to rear of Key as measured from either the front of the Carrier or the front of the normal gas "nozzle" portion of the Gas Key, by as much as 0.25", or more preferably as much as 0.30", or even more preferably by as much as 0.35" or more, and most preferably by as much as 0.390"-0.420" or more and most preferably by 0.410-0.650" or more. This dimension may be technically reduced by as much as about 0.975" thus improving stroke in accord with at least one aspect of the present concepts. Effectively, this shortens the distance from less than the current nominal 2.75"-2.775" (depending on tolerances) from the front of the Carrier to the rearmost part of the Gas Key which enables longer movement rearward or stroke in accord with aspects of the present concepts.

Viewed another way, the distance from the rear of the Carrier to the rear of the gas key can be made greater than the approximate 3.90" currently used per TDP specs as adjusted in dimensional changes stated above. The approximate 3.90" dimension allows a slight gap or margin in maximum travel when considering the nominal 3.75" stroke available in various configurations. This gap is reduced as stated in this invention.

This shortening of the TDP Gas Key from current 2.465" can be accomplished, in at least some aspects, by decreasing the space between the screw/bolt configuration in the current TDP specs of 0.500" (+/−0.003") between hole centers and/or using smaller than current spec 8-40 bolts, or 8-32 bolts and/or decreasing the material proximate to the bolts below that of the current TDP specs. Stated differently, the bolts and corresponding holes can be reduced in size, and the distance between the bolts and bolt holes may be reduced to permit shortening of the Gas Key and therefore achieve better stroke. This can also be accomplished by making the bolt pattern non-linear ("stacked") up to a staggered or even side by side bolt configuration. Furthermore, the amount of material used in the TDP gas key may be reduced or altered to decrease the rearmost part of the gas key—which will enable more movement or a longer "stroke" travel of the bolt carrier group (BCG) within the upper receiver of the firearm.

Corresponding changes in bolt hole positions, size, spacing, etc. in the carrier body are also disclosed as part of these changes. In extreme cases, the anchor points for the key can be advantageously "buried" or machined into the carrier body to the rear or even the side to permit maximum rearward movement or stroke. This would use anchor points to the key that are lowered from present TDP dimensions to permit additional rearward travel or stroke.

In conjunction with equivalent reduction in the buffer length, by reducing material in the buffer body length and/or in the buffer bumper size, this will allow greater "cycle length" than the current which is specified at a nominal 3.75" in the firing cycle. The amount of additional travel is at least 0.020", and with sufficient changes made can be as much as 0.390", even up to 0.420". With additional structural changes described previously to other parts such as the hammer, charging handle, etc. this can be made to be as much as 1.230". Additional stroke of up to 0.415"-0.650" can be fairly readily accomplished without any hammer redesign or without major component redesign save for the hammer lengthening disclosed herein. With the AR10, the length of the rails may be the deciding factor to "stroke", in conjunction with consideration of the Gas Key and Buffer. Thus they should be reduced in length accordingly.

The optimal length, or "sweet spot" for buffer length to maximize stroke is greater than 2.65", but less than 3.25", given a normal specification (TDP) Carbine buffer tube. This dimension includes Carbine systems and can be adjusted commensurately for Rifle length, commercial length systems such as the VLTOR "A5" system, etc. In other words other systems use a different length buffer and buffer tube but still permit only a nominal 3.75" of stroke. If the buffer is shorter than 2.55"-2.65" (depending on tolerance stacking), then the bolt carrier can disadvantageously "fall" off of the hammer, and the hammer can fall ahead of the carrier or bolt. This will lock the bolt/carrier behind the hammer if the hammer is not improved as described. If this happens the gun will lock up severely. Thus the hammer must be an "improved" model as disclosed if the longest stroke is desired. Either of these will cause a catastrophic failure which may result in the loss of life, game, or match in defense/combat, hunting, or sporting situations.

Current TDP buffer lengths (for carbine buffer tubes) are either 2.50" for AR-10 (and equivalent) carbine models and 3.25" for AR-15 (and equivalent) carbine models. Current TDP buffer bodies are 0.400" shorter than overall length, with the difference being the external Buffer Pad length of nominal 0.400", with the internal Pad length (that part of the Pad inside the Buffer Body when assembled) of a nominal 0.473", Longer Buffer Pads or Buffer Body extensions—typically adding 0.10-0.15" to as much as, 75" to the nominal 2.50" length may be used on AR10 style buffers to lengthen them for use in a conventional system thereby providing optimized "stroke". In accord with at least some aspects of the present concepts, buffers are provided with lengths shorter than 3.20" and longer than 2.65" to thereby increase stroke length even whilst using a normal carbine buffer tube without "overrunning" the hammer where the carrier over strokes the hammer and the hammer may fall ahead of the carrier during fire which can cause a catastrophic gun malfunction.

Yet additional aspects of the present concepts include buffer tubes having different lengths from normal TDP carbine buffer tubes, which may be used singly or in combination with the aforementioned shortened buffers or standard length buffers to create a stroke capacity greater than 3.75" travel (subject to tolerance stacking). It is to be noted that, conventionally, stroke is limited to a nominal 3.75" in rifle based systems, as well as Carbine and other firearms (e.g. Personal Defense Weapon (PDW), Firing Port Weapons, etc.). This is due to the obstruction formed by the rear end of the gas key (or equivalent) and/or the buffer/buffer Tube design. The shortened Buffer as described may also be used in cases with different configuration gas keys, for example integrally machined keys that may present a different length, in order to provide optimal stroke as described. This combination is specifically reiterated and disclosed here for emphasis.

Modification to form a shorter "length" of the rear most part of the gas key (or equivalent) in accord with at least some aspects of the present concepts, as measured from the front of the carrier to said part, coupled with changes in buffer and buffer tube length, in accord with at least some other aspects of the present concepts, permit a longer travel or stroke (e.g., greater than 3.75" travel).

The above-noted dimensional changes (e.g., to the buffer, buffer tube, gas key, etc.) are equally applicable to firearms systems that do not utilize removable gas keys (e.g., by removing the staked gas key screws), but instead utilize, for example, integrally milled keys (which may be shorter than external 2-piece carrier/key configurations). This disclosure is reiterated here for emphasis.

In at least some aspects of the present concepts, the leading or trailing ends of the Gas Key "base", the non-nozzle part of the gas key, are made to be narrower than the widest or outermost part of the key itself. Other non contact or even contact points herein may be narrowed as well. The contact points may be widened beyond TDP to the maximum extent permitted by the upper receiver dimensions or otherwise. These concepts result in more consistent operation and velocity of the BCG (Carrier, Bolt, Key, etc.) of the gun within the upper receiver, and create less drag, especially in austere conditions. They also make the gun less susceptible to malfunctions in the case of dirt, debris, of firing fouling accumulation. The reduction in surface area creates less friction and more consistent operation. This is especially true as the carrier and key oscillate or move within the upper receiver creating irregular friction and drag via pitching, yawing, rolling, etc. These dimensions maximize stability while minimizing friction or drag.

Enhanced Stroke Improvement—Gas Key

Enhancement of the stroke in accord with aspects of the present concepts enables the bolt carrier group (BCG) to increase the forward and rearward motion by more than 5%. This range could be from 2%-6%, or preferably 4%-7%, or more preferably 6%-10%, or most preferably 8%-12% or more. With component redesign, as disclosed herein, travel improvements over 12%-20% and greater are realized. This enhanced stroke spreads out the recoil forces over distance and time, reducing perceived recoil and serving to reduce the cycle time or rate of fire, given that the BCG has more space to operate within due to the longer operating "stroke".

Current specs in the TDP allow only an approximate distance from full cycle (bolt clears the bolt catch and can lock open on an empty magazine, a desirable feature) to "bottoming out" (buffer impacts the rear of the buffer tube, which transmits great shock—an undesirable problem) of approximately 0.110"-0.140", with 0.130" being fairly typical. The aforementioned changes will increase this distance from full cycle to bottoming out (i.e., stroke length) significantly, preferably to at least 0.175"-0.200", more preferably to at least 0.200"-0.420" or more and ideally to 0 . . . 390"-0.560" or more, and could be extended by as much as 0 . . . 550" to 1.00" or more, which triples or otherwise increases the "sweet spot" (additional travel or stroke before "bottoming out" after clearance of the bolt lugs past the cartridge in the magazine and bolt catch, as described) of optimal operation. This will enable the firearm to operate more smoothly and reliably over a wide range of conditions by considerably lengthening the amount of "sweet spot" disclosed previously. As used herein, the "sweet spot" is the distance between the minimum to feed (forward portion of bolt lugs cycle behind rear of cartridge in magazine to feed new cartridge), more preferably to lock open the Bolt Catch (avoiding the failure to lock back), and from that point to maximum stroke or extent possible, which now has a jarring impact when the Buffer/Pad has a hard impact into the end of the Buffer Tube. Ideally, the longer stroke will more effectively dissipate recoil energy but also minimize or eliminate this hard impact of the Buffer Pad hitting the end of the Buffer Tube.

This increased stroke length also permits development of greater momentum in bolt "runup" during feeding or forward movement from the rear, which is the time and energy available to have the bolt strip the next cartridge from the magazine, feed it into the chamber, and lock the bolt into battery. This increased momentum will help ameliorate failure-to-chamber and failure-to-feed problems.

Additionally the increased stroke length in accord with the present concepts provides the magazine more time to "feed" the next round into position. The greater time and space available for this process serves to lower the rate of fire which is especially helpful with severely overgassed or very high rate of fire guns. The additional movement rearward, past the magazine and bolt catch, permits longer delay or "dwell" for the cartridge to feed from the magazine, which is optimal. Additionally, the space provides better release of stronger bolt energy in moving forward in feeding of the cartridge from the magazine into the chamber, and locking of the bolt lugs into the barrel extension into an "in battery" position so that the next round may be successfully fired when the hammer strikes the firing pin. The gun must be "in battery" in order for it to fire safely and successfully. Out of battery firing can lead to severe injury, equipment destruction, and many other undesirable consequences.

The present concepts also include, separately or together with the aforementioned shortening of the rear of the gas key to enable more travel, the lengthening of the forward part of the gas key (referred to as the "nozzle"), which covers the gas tube from current TDP. By extending the Nozzle length forward beyond current TDP dimensions of nominal 0.283" from the front of the Carrier body, the gas key will cover high pressure combustion gasses discharging from the gas tube for a longer period of time during normal firing. This will decrease the amount of fouling blown into the upper receiver and bolt/bolt carrier. The gas key can be extended forward by any distance over current TDP, notably by at least 0.05", more preferably by at least 0.10", and even more preferably by at least 0.20", and could be as much as 0.315" with the 5.56 mm version (AR-15, M-16, et al.) and as much as 0.365" with the 7.62 mm version (AR-10, SR25, et al). Optimally, the extension of the nozzle should not extend beyond the forward edge of either the Charging Handle (CH) or upper receiver opening.

In addition to modification of the length of the gas key in accord with the present concepts, or separately thereto, the width of the gas key has also been determined by the inventor to be modifiable to provide effective results. In accord with at least some aspects of the present concepts, the gas key is narrowed from current TDP dimensions of nominal, 400" to thereby decrease the contact or frictional surfaces between the gas key and the upper receiver. This may be done in a regular or irregular manner. This means that the contact surface may be continuous or non continuous and may be shaped in order to minimize contact area while maximizing part stability. This may be accomplished by extending the maximum width of these parts to beyond TDP dimensions to as much as 0.406" more and even 0.410" or more to increase the side to side stability.

In addition to narrowing the gas key to reduce frictional contact and drag, in some aspects of the present concepts, the key is widened to beyond current TDP dimensions, to enhance side to side stability and decrease roll, up to the width available within the receiver which is 0.406"-0.410". Widening of the gas key is from TDP better stabilizes the bolt carrier group (BCG) within the upper receiver and promotes smoother, more reliable operation.

The contact portions of the gas key (i.e., those surfaces that come into contact with the upper receiver) may be straight, or may alternatively be curved, grooved, beveled, chamfered, radiused, angled, relieved, or discontinuous, or otherwise reduced in possible contact area with the upper receiver.

The chamfering, radiusing, beveling, or otherwise relieving the "sharp" edge created at the front of the gas key body with the forward 45° angle is explicitly disclosed, as is the elimination of this sharp edge on gas keys. Similar techniques may be applied to the sharp rear 90° edge for additional advantage. Either angle may be changed for more optimal operation and clearance as well. These parts of the Key may be narrowed partially or entirely in order to accomplish the same objectives.

In accord with at least some aspects of the present concepts, either in isolation or in addition to the aforementioned narrowing of the width of the gas key, the contact area from the gas key to upper receiver is shortened from current TDP to a length less than the current length. This decrease in length decreases the material contact and friction between the parts, which helps to ensure smoother and more reliable operation of the firearm.

The Key contact portion—the sides which may contact the upper receiver—height of 0.182" nominal per TDP may be increased or decreased to optimize stability and decrease friction and drag.

As noted above, the above modifications relative to the TDP can be implemented separately or in any combination.

While it is generally known that the upper received is fouled in operation, it is not generally appreciated how badly this fouling, and resulting increase in friction, affects the forces and friction applied to the BCG and the gas key. Over time, this fouling has been observed to, for example, affect the velocity of the bullet exiting the barrel (e.g., a change in between about 80-120 ft/s after 10,000 rounds fired). The modifications in accord with the concepts disclosed herein, whether taken singly or in combination, dramatically reduce this fouling and resulting frictional affects arising therefrom.

Figure 12C:
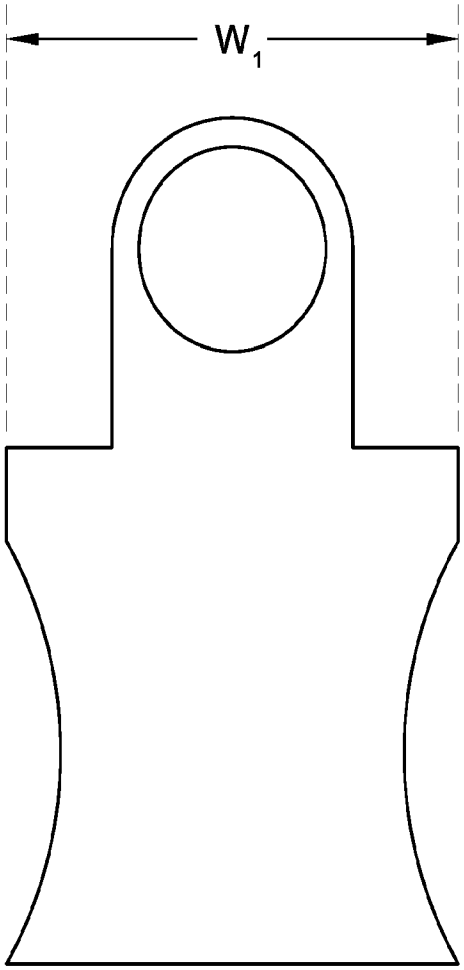
FIG. 12C shows aspects of another gas key in accord with at least some aspects of the present concepts.
Figure 12B:
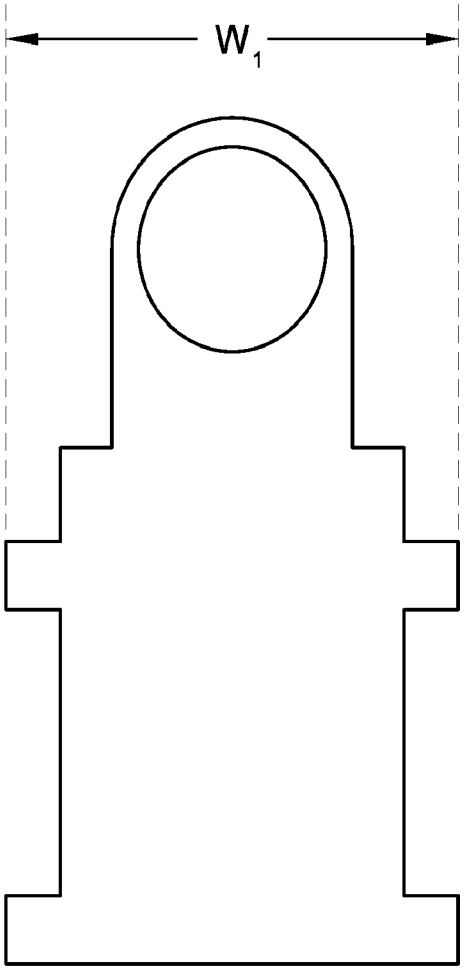
FIG. 12B shows aspects of a gas key in accord with at least some aspects of the present concepts.
Figure 12A:
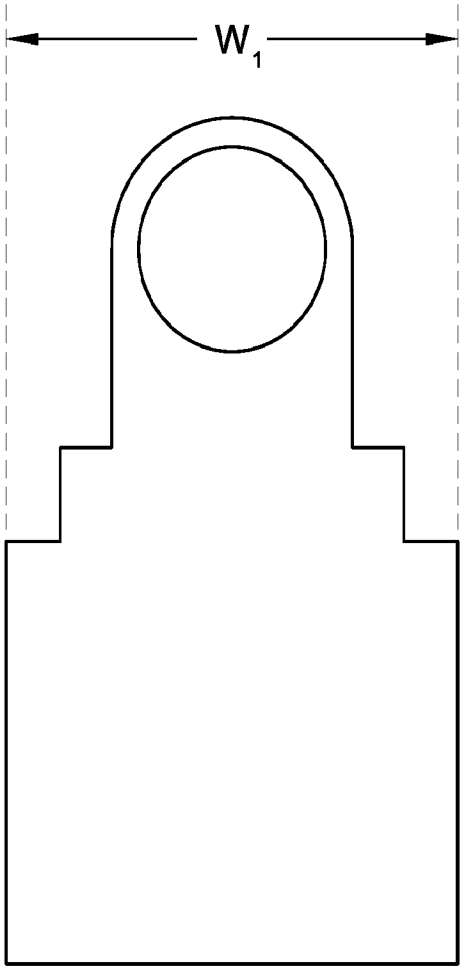
FIG. 12A shows aspects of a conventional TDP gas key.

The current amount of material in the side "contact" portion, per side, of the gas key is about 0.255 square inches, with approximately 0.217 square inches exposed above the upper rail portion of the TDP bolt carrier. In accord with at least some aspects of the present concepts, the amount of material in the side contact portion is decreased, per side, below that of the conventional TDP exposed surface. This may be done by the use of grooves, sand cuts, bevels, or other techniques without limitation. By way of example, this contact portion is reduced to the smallest area possible without making it so small that it "cuts" into the upper receiver, due to the Cam Pin size. In some aspects, this can be made to have a contact surface of as little as 0.040-0.050" high, and possibly smaller, with said surface being 0.040"-0.080" long, and ideally radiused. In other words, this area may be reduced by 1-15%, 15-30%, 30-70%, or greater than 70-95% or more as compared to current dimensions in the TDP. The "twisting" of the carrier due to pitching or yawing or rolling during cycling creates significant friction in the conventional TDP configuration which interferes with the "timing" of the gun—the timing being the proper operation of all parts together to ensure proper and optimal operation. This reduction in the amount of material in the side contact portion can be accomplished, for example, by shortening the length of the gas key horizontal contact area and/or by narrowing the width of the gas key from current 0.4015" maximum and 0.4005" nominal, in order to provide space for debris to collect or flow and to reduce frictional surfaces. The height of the outer contact surface that which may come into contact with the charging handle of upper receiver, may be reduced as well in accord with at least some aspects of the present concepts. There may be a combination and use of reduction and increase in width to create an irregular surface that will, overall, lessen the contact surfaces from conventional TDP dimensions. By way of example, as shown in FIGS. 12A-12C, a comparison of a cross-section of the gas key as between the TDP gas key (FIG. 12A) and the improved gas keys in accord with aspects of the present concepts (FIGS. 12B and 12C) shows the differences in cross sectional area (e.g., the lateral width reduction on the sides and lateral width increase toward the upper part, such as but not limited to being up to 0.406"-0.410" wide at the upper part). The wider portion of the gas key that may come into contact with the receiver is about 0.187" high this contact surface may be widened or narrowed. The uppermost portion of the side of the gas key, the currently recessed upper 0.060" or so (as indicated in TDP), may be further narrowed from current nominal 0.338" or it may be widened. In all cases, narrowing of the part will reduce contact friction when in operation, and widening the part will increase part stability during operation.

In accord with at least some aspects of the present concepts, the contact portions of the Gas Key (radially outermost portions) that stabilize the bolt during operation, are advantageously extended outwardly beyond the TDP dimensions of the part to as much as the width of the "slot" within the Upper Receiver, which is 0.406"-0.410". This modification to the conventional design increases stability and movement of the Carrier, and reduces side to side movement of the carrier. This modification also enables different placement of the bolts, which permits smaller bolts than permitted by the TDP specs, and requires less surrounding material than is called for in the TDP. These modifications can be used to further shorten the length of the key when measured from rear most point to the front of the carrier. The reduction of potential contact length and contact height or a combination by 1-10%, more preferably 10-30%, even more preferably by 30-70% or more, and most preferably by 70-95% or more is disclosed. The increase of part width as disclosed to increase lateral and other stability and improve operational effectiveness is repeated for emphasis.

Combined with other disclosures, these inventions ensure that even though the carrier is subject to less frictional contact, it will be more stable due to critical dimensions being changed.

Figure 3B:
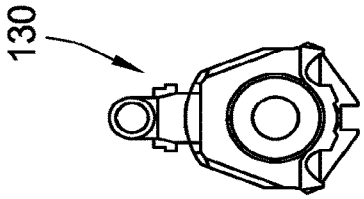
FIGS. 3A-3B show, respectively, a side view 3A and a front view 3B of a bolt carrier in accord with at least some aspects of the present concepts. These illustrate the lowered cross sectional area as compared to 1D.
Figure 3D:
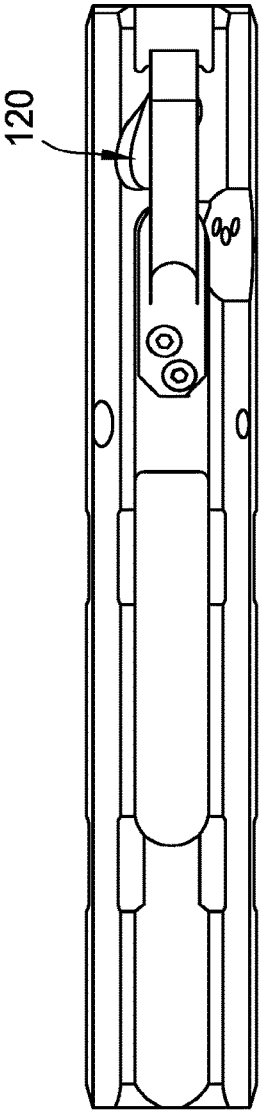
FIGS. 3C-3D show, respectively, a sectional view taken along the mid-line of FIG. 3A (reversed direction) and a top view of a bolt carrier in accord with at least some aspects of the present concepts.
Figure 3A:
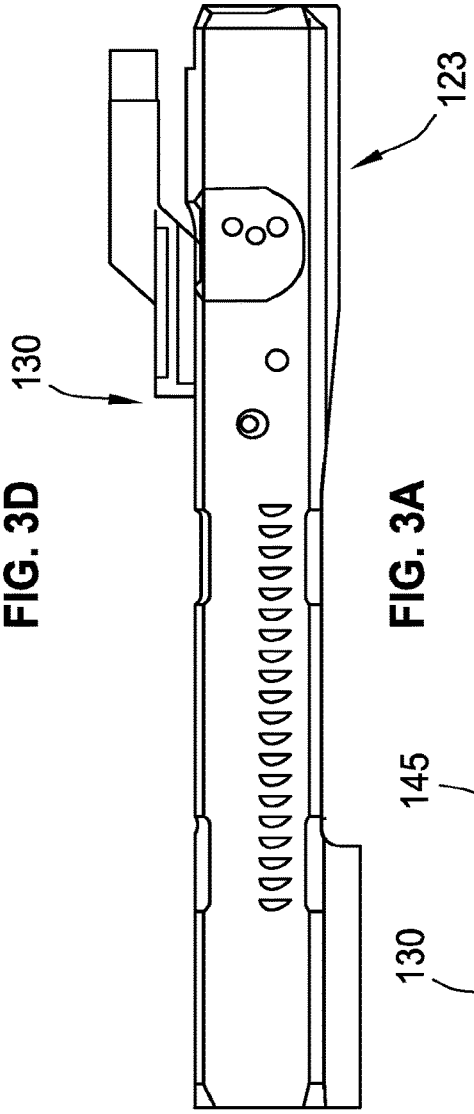
Figure 3C:
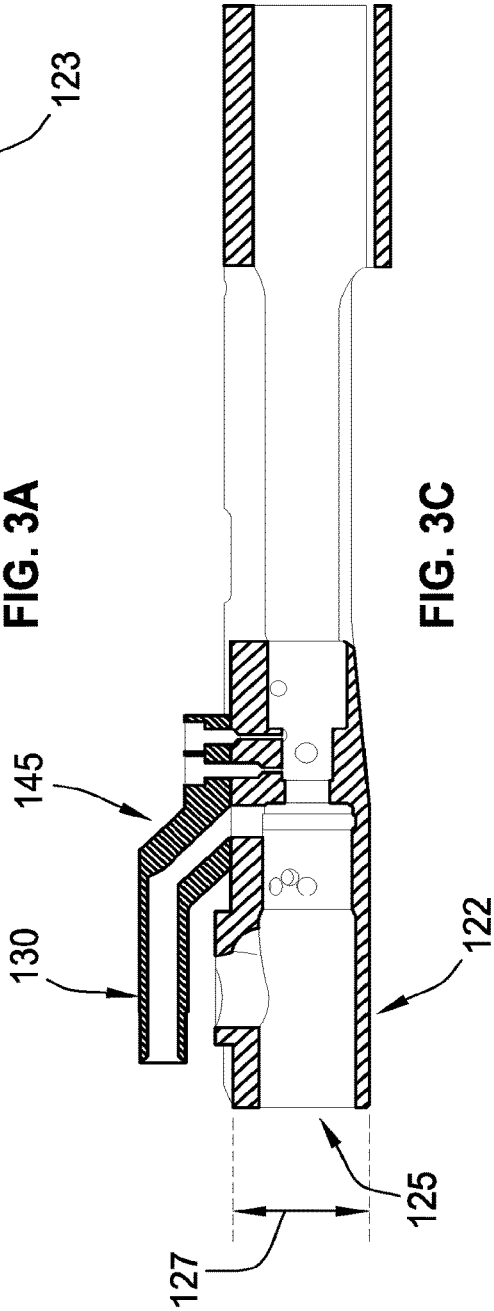

The gas key may have the hole by the nozzle changed to a single dimension 140 in FIG. 3C in order to ease manufacturing cost and time. The angle of the 45° hole 145 may be changed to more or less steep (>45°, and <45°) to help better optimize gas flow. The 45° hole may be changed in size, either larger or smaller, from current TDP dimensions to better optimize gas flow, this may be as large as 0.172" in size. Stated differently, the bore angle is "steepened" to more than 45° as measured from the "bore" or hole that accepts the gas tube (i.e., closer towards a 90° turn of the gas from the "nozzle" to the gas hole atop the carrier). This configuration will slow gas flow somewhat by slightly impeding flow, which can further reduce rpm or cyclic rate.

In addition to lengthening the nozzle end, the distance between the nozzle and the exit hole at the bottom of the gas key, which interfaces with the carrier gas hole, may be reduced to support forward movement of the said carrier hole.

Outrigger—Gas Key

Figure 11A:
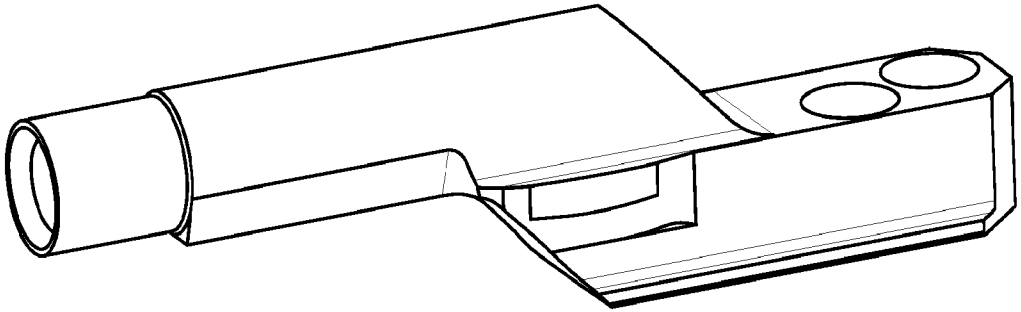
FIG. 11A shows a gas key in accordance with one aspect of the disclosure.
Figure 11B:
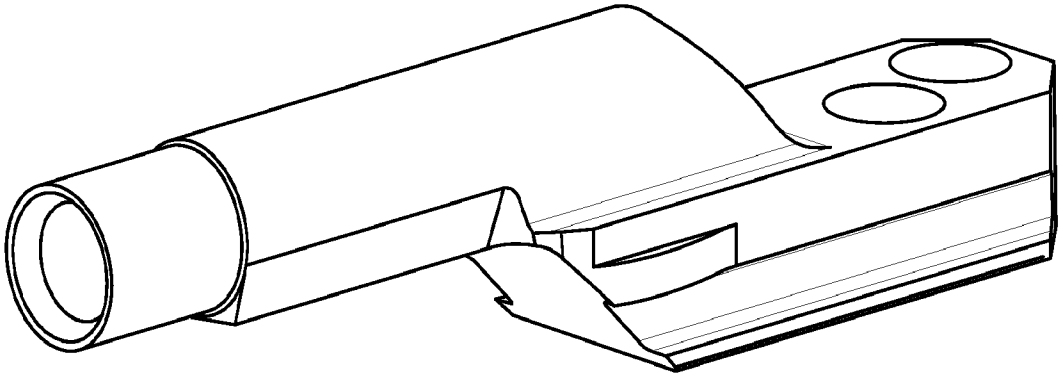
FIG. 11B shows a gas key in accordance with one aspect of the disclosure.

In some aspects of the present concepts, such as is shown by way of example in FIG. 11, one or more lateral members (also termed "outriggers" here) are provided on one or both sides of the gas key to prevent side-to-side movement of the gas key within a slot cut within the upper receiver on the Stoner FOW (Family of Weapons), positioned and dimensioned to slidingly receive the lateral members. The lateral members, by way of example, may be formed by a widening of at least a portion of the gas key from current TDP (0.4005" to 0.4015") to as much as the commensurate channel within the upper receiver and/or by a narrowing the current dimensions of the upper receiver (stated as 0.406" currently, to a maximum of 0.410" or otherwise permitted by the receiver dimension) or of the charging handle to prevent side-to-side (lateral) tilt of the gas key and bolt carrier within the firearm. These may be used in conjunction with changes disclosed above relative to the gas key or other contact surfaces as well.

The lateral members or "outriggers" may span the entire length of the gas key, or a portion thereof (e.g., less than the current dimension of the gas key in contact with the counterpart surfaces (e.g. charging handle or receiver, for example)).

Alternately, the lateral members or outrigger(s) may use less material in order to provide better operation in austere conditions (e.g. dirty, unlubricated, etc. for example). In particular the key itself or the outrigger may use less material from end to end or from bottom to top than current TDP dimensions. This refers to material that comprises possible contact areas of the gas key—that may come in contact with other parts of the firearm such as the upper receiver or charging handle, for example.

Although the term "lateral" is used herein for convenience with respect to the lateral member(s) or outrigger(s), it is to be noted that these member(s) need not be perpendicular to or horizontal with respect to the gas key or receiver and may, instead, be disposed at one or more angles relative thereto, even vertically.

The equivalent of the "outrigger" can be made by reducing the contact portion of the Gas Key or equivalent to less than the total length of the part, or less than the total possible or extant contact height nor width of the part.

In addition to reducing the contact portion to less than the total length, or width, or height of the part various techniques may be used to accomplish the same objective. These include the use of grooves, flutes, sand cuts, irregular surface or shape as well as all other variations that accomplish the same such as ribs, dimples, chamfers, etc.

Cam Pin

Figure 4B:
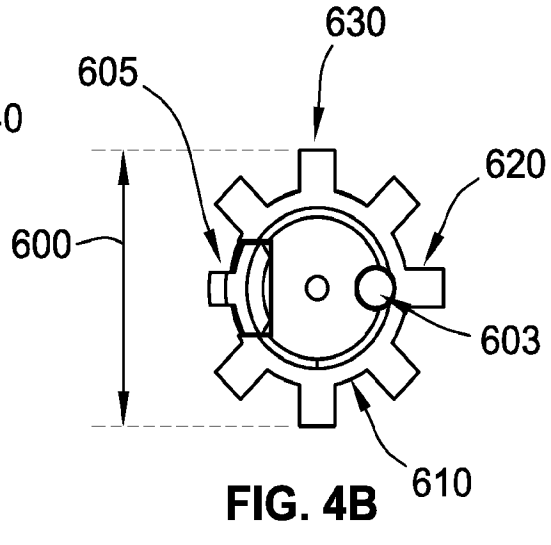
FIGS. 4A-4B show, respectively, a side view and a front view of a bolt in accord with at least some aspects of the present concepts.
Figure 4A:
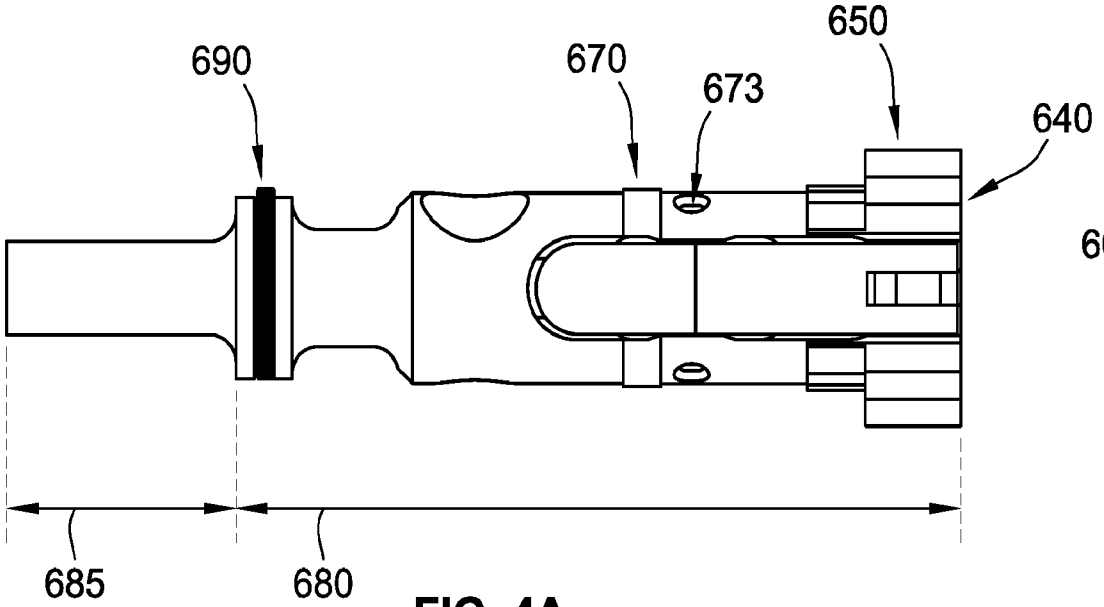
Figure 4D:
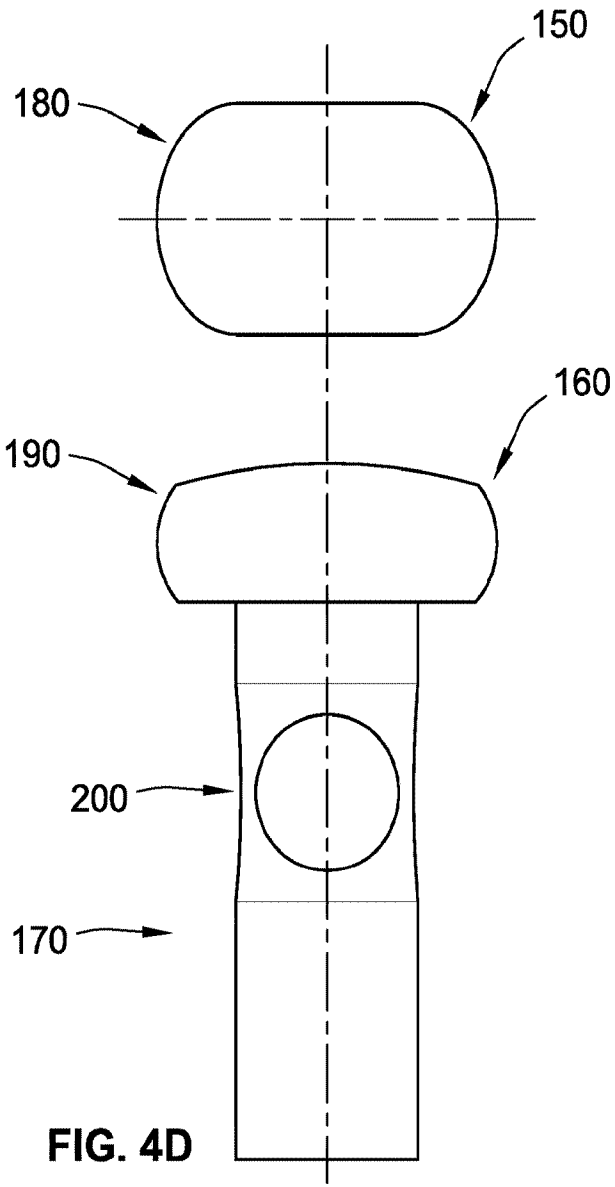
FIG. 4D shows a top view 150 and a side view 160 of a cam pin, in accord with at least some aspects of the present concepts, showing radiused outer "wings" 180 which reduce contact area, drag, and wear on upper receiver, a downwardly sloping "head" 190 and a body showing a relief cut 200 to reduce drag against cam path in the carrier.

In at least some aspects of the present concepts, one or more irregular surface areas (e.g., undulating surfaces, grooved surfaces, dimpled surfaces, crosshatched surfaces, etc.) 200 are used on the Cam Pin 170 FIG. 4D and the corresponding cam pin slot on the bolt carrier, in order to promote smoother more reliable operation of the firearm, especially in austere conditions. Research conducted by the inventor has shown that much friction of locking the bolt into battery comes from fouling of this area. The fouling dramatically increases friction which makes it more difficult for the firearm to fully "lock" into battery. The disclosed irregular surface(s) will reduce the metal to metal friction surfaces. By way of example, the irregular surface(s) may be formed by creating a non-flat surface—such as a groove, chamfer, or bevel, for example—on the cam pin cutout- or Cam Path—portion of the Carrier, or increasing or decreasing the diameter of the cam bin body from the current 0.3105" nominal and 0.3100" minimum called for in the TDP. The Cam Pin body may have a surface made in a non linear manner (such as a groove, fouling relief cut or otherwise relieved) 200 to ensure better operation as well. This disclosure applies from the bottom of the cam pin, upward 0.667". Similarly, the part of the cam pin slot (Cam Path) cut into the carrier may be made irregular surface in order to decrease the contact area against the cam pin during operation. The Cam Path 120 may be milled, slotted, beveled, chamfered, extended, radiused or recessed or otherwise changed beyond any shown in the TDP to support this disclosure of reduced contact area. The "head" of the cam pin 190 may be angled, radiused or otherwise changed to reduce the frictional or contact surface during operation. The head may be narrowed from nominal 0.400"-0.405" or otherwise indicated in the TDP, and it may be more sharply or aggressively rounded or radiused to promote smoother operation. The head portion 180 may be also increased to greater than TDP dimensions of nominal 0.400" width to the greatest extent possible—up to the opening in the Receiver to more optimally stabilize the Bolt during cycling. The some beyond TDP nearly all or the entire contact or outer part of the head may be radiused to minimize contact surface- or only a portion of it may be more rounded or radiused or otherwise reduced as compared to TDP dimensions. These changes will reduce the contact area of the cam pin touching the upper receiver by 5-10%, more preferably 10-25%, even more preferably 25-50%, and most preferably 50-90% or more compared to current TDP dimensions.

Figure 4C:
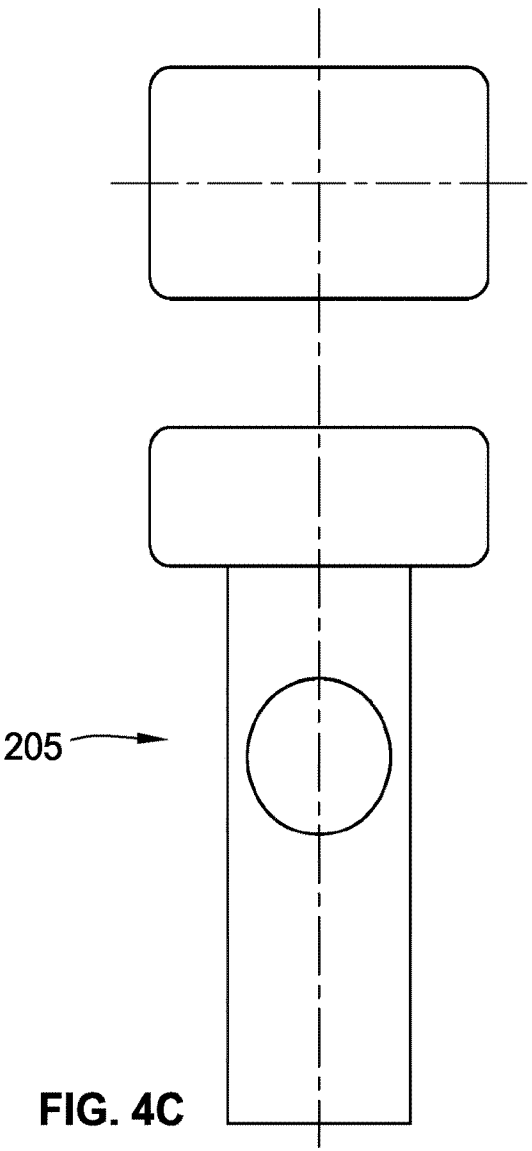
FIG. 4C shows a top view and a side view of a conventional TDP cam pin.

As shown in FIG. 4D, the entire outer portion of the cam pin head 150, that which comes into contact with the receiver walls, may become a radiused or chamfered or beveled or otherwise reduced in height surface in order to decrease contact area and resultant drag to the maximum extent possible. That is to say, the two outermost edges as currently seen on the extant TDP cam pin of FIG. 4C. The outer contact surface are the sides of the cam pin head, in firing operation the shorter aspect are the front and rear, with the wider elements forming the side to side contact areas. The sides come in contact during firing, while the front and rear do not.

These measures (the reduction of the contact surfaces in the cam pin body and head contact areas—that come into contact with either the carrier cam path (body) or upper receiver (head) during normal firing of the gun) will significantly reduce friction or drag in the operation of the firearm, especially in adverse conditions.

Figure 7A:
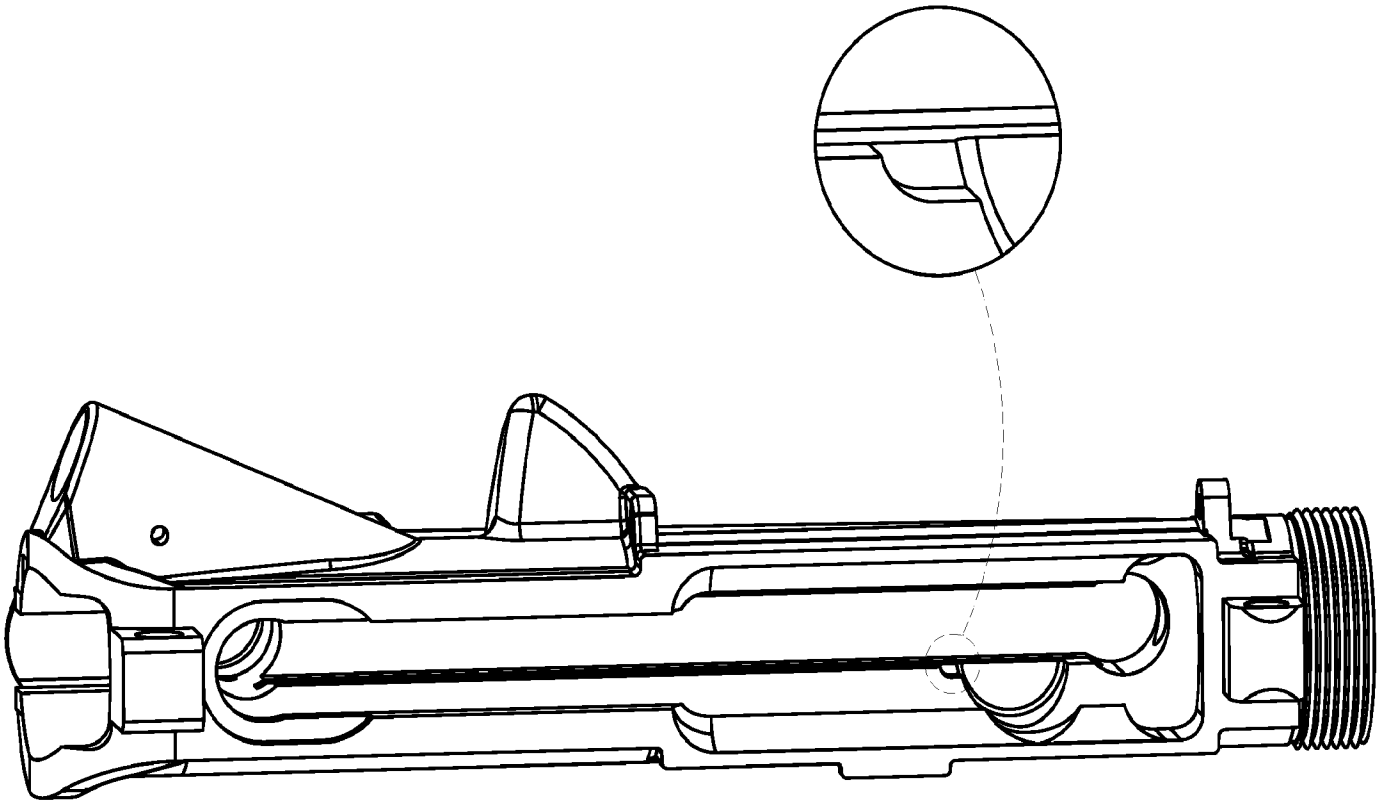
FIG. 7A-7B show a carrier cam slot cutout 380, in accord with at least some aspects of the present concepts, showing a further cutout 390 behind the cam cutout or pocket.
Figure 7B:
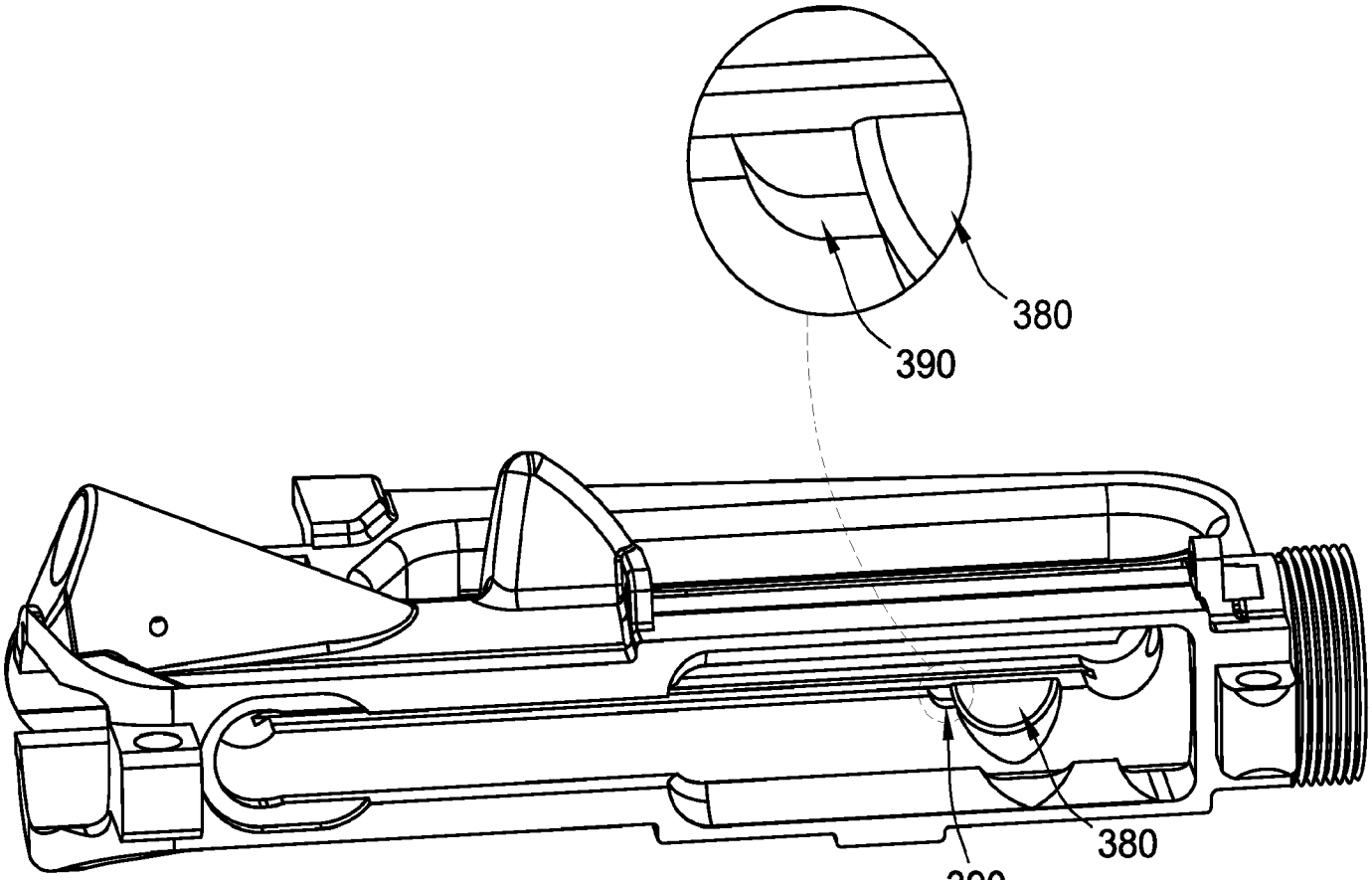

Another aspect of the present concepts includes moving the rear edge 390 in FIG. 7B of the cam pin "pocket" 380 or recess in the upper receiver. Conventionally, it is about 2.25" from the front edge of the upper receiver body, where the barrel nut attaches and secures the barrel. In accord with some aspects of the present concepts, this edge, or corner, is moved rearwardly from the conventional specification position, ideally to at least 2.35"-2.45", and even more ideally to at least 2.45"-2.65" from the front edge of the receive body. Most ideally this will be at least 2.65"-2.75" or more from the forward portion disclosed above. This provides a relieved area to minimize or eliminate contact friction or impact/grinding of the cam pin head to the upper receiver, thus ensuring optimal operation of the gun and maximum part life. In other words, a length similar to the channel or Cam wear path that is visible in some guns (severe use or out of spec parts, for example) may be intentionally manufactured into the actual cam recess to ensure optimal operation of the gun.

Additionally, the area of the upper receiver subject to wear by the cam pin head, immediately aft of the "Pocket" may be machined out to reduce the drag and wear by the cam pin head. Even as little as a surface 0.010"-0.050" or more in depth, and as little as 0.015"0.075" or more in length is believed to yield significant gains in consistent operation.

The entire recess may be adjusted, or merely the area subject to contact or erosion by the cam pin head may be adjusted.

Bolt

In accord with at least some aspects of the present concepts, the bolt lug diameter 600 FIG. 4B may be shortened, below that of the 0.738" minimum defined in the TDP, to between 0.730"-0.738", and even between 0.700"-0.730", and at the maximum extent between 0.650"-0.700". This will ensure proper operation, especially in austere conditions. This will still be sufficient to feed cartridges but will reduce drag of the Bolt Lugs 650 FIG. 4A within the Barrel Extension in severe conditions. Shortening the Lugs 620 will also provide less stress on the parts during operation. Beyond this changes are possible but require re-engineering the lower receiver, which is undesirable. With the aforementioned changes to the bolt lug diameter, the bolt will still operate well and pick up and feed new cartridges. The lugs are relatively stronger if smaller diameter (outer edge to outer edge of Bolt lugs) 600, which provides decreased lug "height" 620, and wider width 630 contribute to a stronger part. Ideally this is coupled with a thicker "rim" 610 around the face of the Bolt (Bolt Face) 640 where the ejector 603 and extractor 605 are found. This Rim 610 can be increase in size radially outward from current 0.075" outer diameter nominal by 0.001"-0.005", preferably 0.005"-0.015", and even more if the center opening of the barrel extension is increased, as is also disclosed herein. In essence, this makes the lugs "shorter" when measured from base to top (e.g. outermost part which creates diameter of bolt lugs). This can be extended to the clearance limits of the Barrel Extension. If the opening in the Barrel Extension is widened, which is disclosed, then the Bolt "rim" 610 can be further widened. In addition to other advantages, this also creates more safety by adding material in case of a catastrophic detonation.

The conventional "unsupported" height 620 of the bolt lugs 650 is at least 0.105", usually more. The width 630 of the conventional lugs is a maximum of 0.104", and usually less. The goal is to change this whereby the width of the lugs is greater than 0.104" (the conventional maximum), ideally 0.1045"-0.107", and more preferably 0.107-0.115" or more. When the barrel extension openings are expanded, as disclosed, this dimension of the lug width may go well beyond stated figures to as much as 0.135" or more. Increasing the lug width (to >0.104" maximum per TDP specs) will also serve to keep the Bolt "locked" in battery longer which has numerous advantages. Thus the wider lug 630 will take longer to "unlock", which is desirable.

By decreasing the lug "diameter" 600, increasing the thickness of the rim 610, and/or increasing the bolt lug width (>0.1045") 630, in accord with the present concepts, major changes in the bolt lug "aspect ratio" are possible. Currently the best conventional ratio possible of maximum lug width (0.104") and minimum lug "height" (from lug base at rim to outer portion of diameter—0.105") is 0.99×. That is the "width" divided by the unsupported "height". In contrast thereto, the changes in accord with the present concepts can improve this ratio from the best case TDP of 0.99× to 1.1×-1.157×. It bears noting that 0.99× represents the best case TDP; conventional values for this ratio can be expected to fall within 0.91-0.97×.

In accord with aspects of the present concepts, the bolt can also be shortened in length from front of bolt lugs to rear of bolt tail. From extant 2.80" nominal total 685 and 2.080" nominal 680 from bolt face 640 to the rear of the gas rings 690 may be shortened either individually or collectively. This permits longer stroke as well as less rotational forces applied to the bolt and lugs during firing. The Bolt cavity or recess of the Carrier may be shortened commensurately, with appropriate changes in the relocation of the gas vent holes, gas input hole, etc.

The firing pin and retaining pin may be likewise shortened from current dimensions to support better clearance and these disclosures. By way of example, they may be shortened by about 3-30% in length, corresponding to potential changes of shortening the bolt or narrowing the carrier body.

The bolt may be better stabilized by reducing the minimum diameter of the bolt recess or cavity of the bolt carrier from current 0.5299" minimum to less than this and ideally to as little as 0.5285". Alternately the bolt diameter maximum 670 may be increased beyond 0.528"-0.5285" to as much as 0.5285"–0.5295". This, coupled with a wear ring 670 that is longer than the extant one (nominal 0.110" long) or more than one wear ring, will better support the bolt during firing. The Bolt is prone to excess movement or "wobble" in the current state which creates excess parts stress and wear, as well as gas leakage around the gas rings. Grooves, sand cuts, and similar modifications without limitation may be put onto the Bolt, and especially the contact areas specifically the "wear ring" in order to decrease friction particularly in austere conditions.

Test firing by the inventor has shown that conventional TDP bolts "wobble" or oscillate much more than expected, which increases parts wear and stress and also contributes to gas leakage.

In accord with aspects of the present concepts, the wear ring(s) may be unified or may use various techniques to reduce drag such as sand cuts, grooves, etc.

Bolt Catch

In accord with aspects of the present concepts, the bolt catch may be improved by changing and improving a number of aspects. This includes changing the weight so that the outer portion (that outside the receiver and roll pin) is made heavier than TDP parts 245 in FIG. 5A. It may also be changed so that the weight on the inner portion (that part inside the receiver or roll pin) is lighter than TDP parts. These aspects may also be used in combination. These modifications, whether taken singly or in combination, serve as a lever to actuate the bolt catch more effectively, which will help reduce failure to lock malfunctions.

In accord with aspects of the present concepts, the bolt catch 240 may also be improved by lessening the friction of the part within the receiver, which may be done by (generally longitudinal to movement of the Bolt Catch parts located within the Bolt Catch recess of the lower receiver) adding flutes, grooves, ridges, rails, dimples or any other feature to reduce contact area between the bolt catch and lower receiver area where the bolt catch is placed (e.g. bolt catch recess).

Figure 5B:
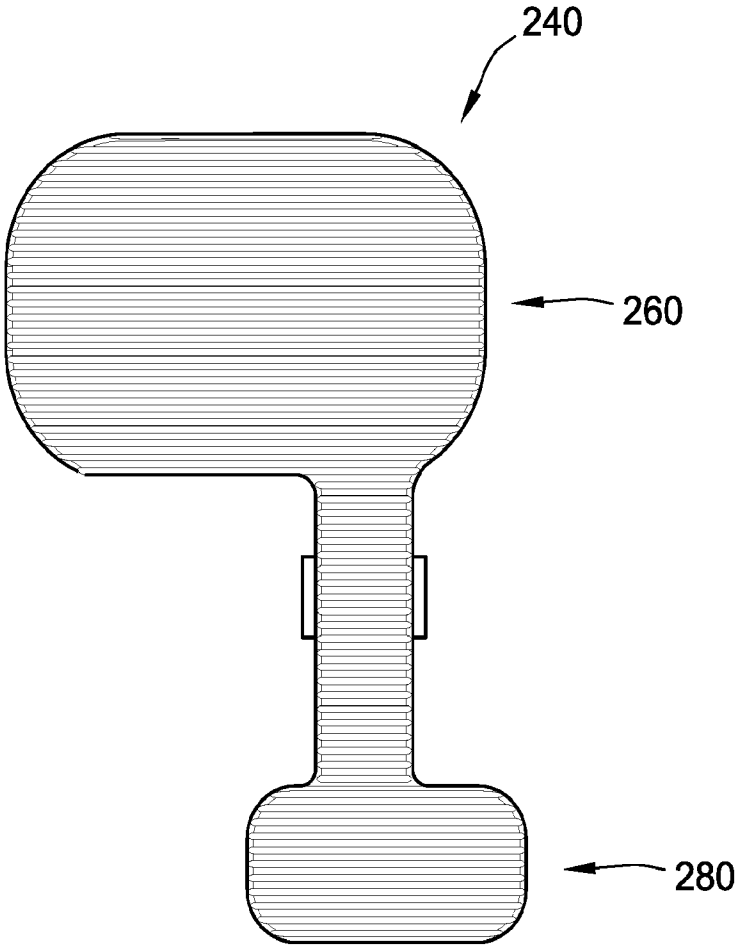
FIG. 5B shows an outside or side view of a bolt catch 240, in accord with at least some aspects of the present concepts, showing a forward bias of the upper pad 260 and a larger lower pad 280, presenting an asymmetric bias of the upper and lower pads wherein the upper pad 260 flares forward and the lower pad 280 has a rearward bias in the normal position on the gun
Figure 5A:
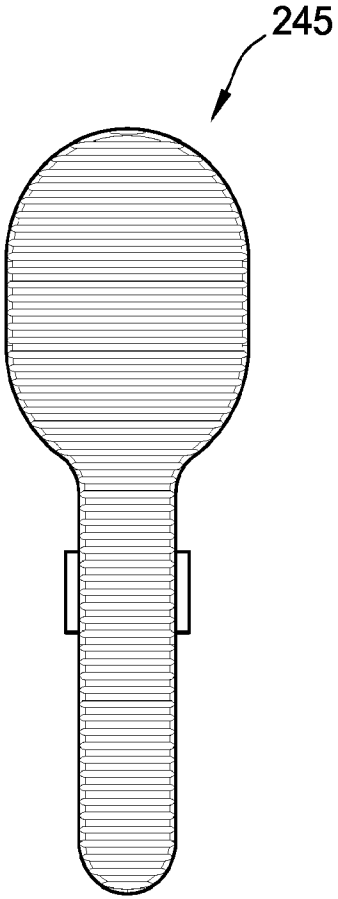
FIG. 5A shows an outside or side view of a conventional TDP bolt catch 200.
Figure 6A:
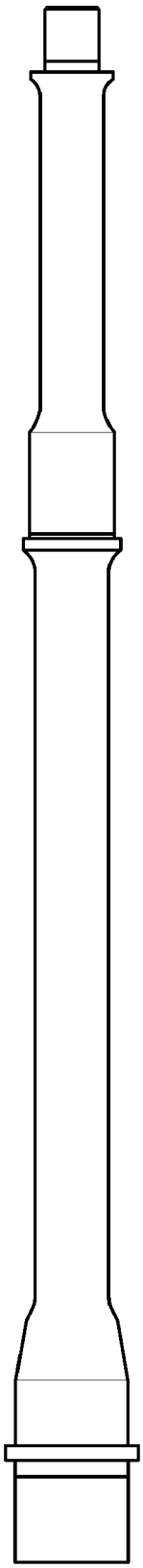
FIGS. 6A-6B show a top view 300 and a side view 320 of a slab-sided barrel in accord with at least some aspects of the present concepts.
Figure 6B:
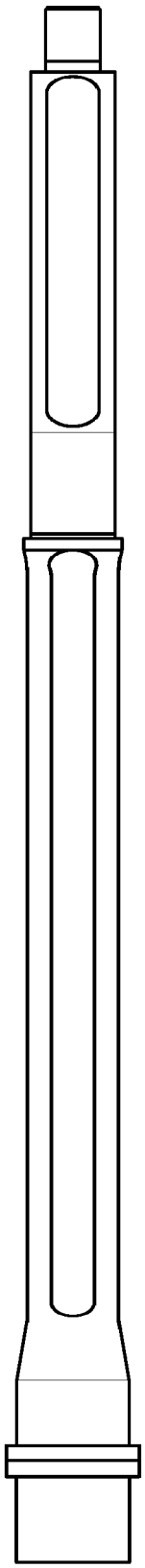

In addition to previous improvements, the "pads" or control surfaces of the bolt catch 245 FIG. 5B may flare asymmetrically. Stated differently, the upper part (or bolt release pad) 260 may, for example, flare forward with the lower part (bolt catch pad) 280 flaring rearward. This will help in operation as the operator will more easily ascertain visually or physically in the case of limited visibility) the upper part (bolt release pad) 260 from the lower part or pad (bolt catch pad) 280.

Either of these pads 260 or 280 may use an angled pad and/or oversize pad, as compared to TDP 245, to provide one or more larger and/or tactilely distinct control surface(s).

Additionally, the internal portion of Bolt Catch—that part located within the firearm receiver may extend rearwardly within the receiver, and outwardly within the receiver. This extension may be carried to the receiver wall generally located on the right side of the firearm near the magazine release and ejection port in either one piece or more than one piece. The extension may be rigid or it may be semi rigid. The extension may exit rearwardly from the receiver, especially by the reinforcement area located near the magazine release or downwardly through the receiver wall. The extension may have a control surface that is located behind or to the rear of the dust cover or the magazine release. The control surface may be used to either activate the Bolt Catch, catching the Bolt Carrier to the rear, or it may be used to release the Bolt Catch, sending the Bolt Carrier forward, as desired by the shooter.

These aspects or improvements may be used together, separately, or in some combination.

Bolt Carrier

Figure 1B:
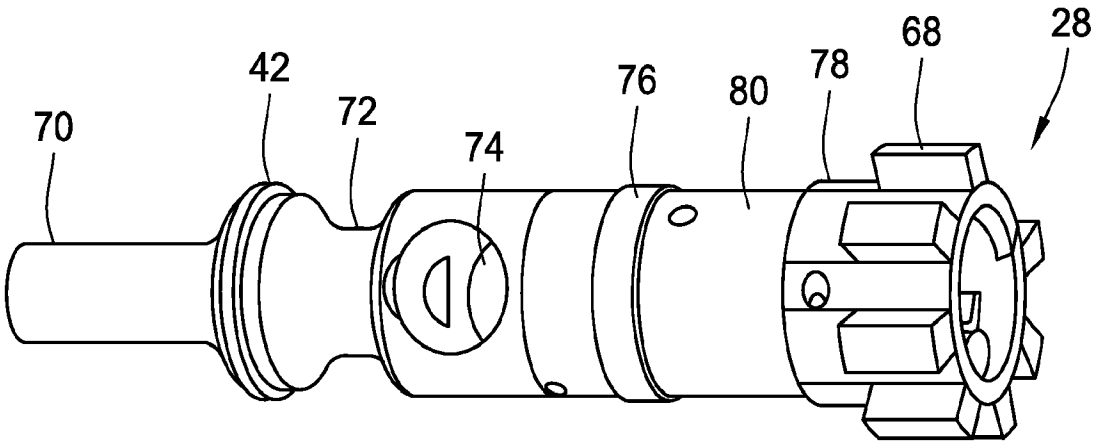
FIG. 1B (PRIOR ART)
FIG. 1B shows a conventional AR-15 bolt.
Figure 1C:
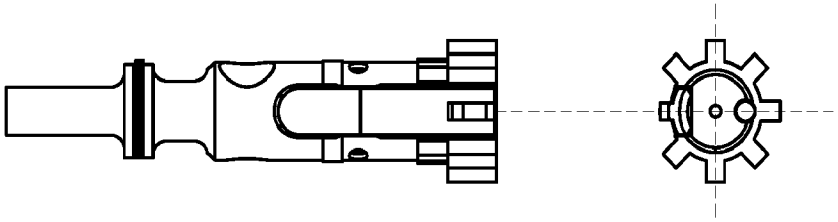
FIG. 1C (PRIOR ART)
FIG. 1C and FIG. 1D show side and front views of a conventional AR-15 bolt and bolt carrier, respectively.
Figure 1D:
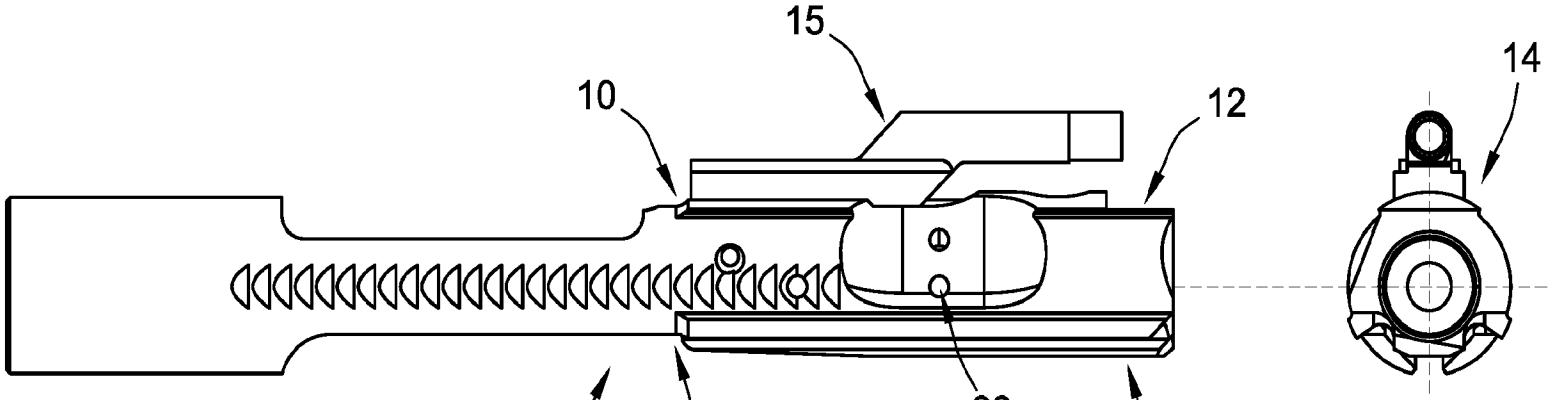
FIG. 1D (PRIOR ART)
Figure 1E:
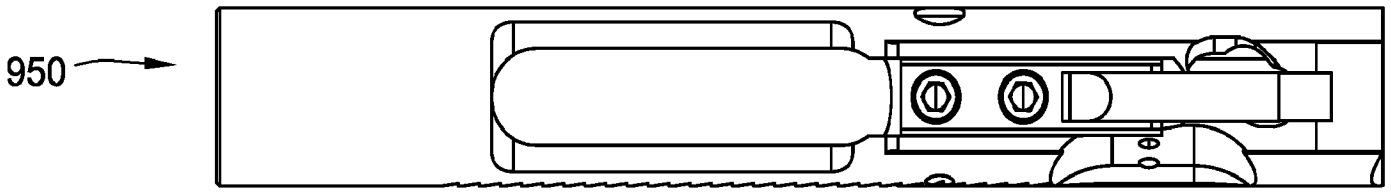
FIG. 1E (PRIOR ART)
FIGS. 1E-1G show a conventional AR-15 bolt carrier from a top 950, bottom 970, and isometric view 980, respectively.
Figure 1F:
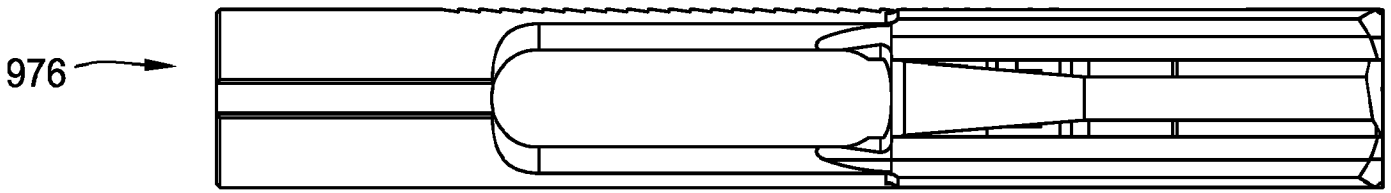
FIG. 1F (PRIOR ART)

The bolt carrier disclosed herein is adapted to enhance operation, particularly in austere conditions. As determined by the inventor, the profiles of the conventional bolt carrier rails 005 in FIG. 1D, the surfaces that come into contact with respective adjacent surfaces of the upper receiver (e.g., the upper rails 010 disposed on either side of the gas key 015, etc.), are too "squat" to operate optimally. By squat it is meant that they are short and wide which impede easy movement, especially in austere conditions. Because of this shortness of length, the carrier 020 is prone to erratic movement (e.g. "pitching", etc.) which creates undue wear and increases frictional forces. Conventional bolt carrier rails are typically 0.108" wide at their narrowest on the upper rails 010, with a length of approximately 2.42". This creates an "aspect ratio" (length divided by width) of 22.40 for the conventional bolt carrier upper rails. In accord with the present concepts, and the bolt carrier disclosed herein, this conventional ratio is altered by narrowing the width of the upper rails, or lengthening them, or both narrowing the width of the upper rails 110 and lengthening them. Stated differently, either reducing the width of the rail to below this dimension, or increasing the length, or a combination will increase this number of the aspect ratio to greater than 22.40 in accord with aspects of the present concepts. Irrespective of length, the width of the Rails may be reduced to less than 0.095-0.105", more preferably to less than 0.085-0.095", even more preferably to less than 0.075-0.085", and most preferably to 0.050-0.075" or less. This may also be viewed as a percentage of reduction in the case of other dimensions, for instance the AR10 Carrier Rail. Such dimensions may be reduced in width by 5-15%, preferably 15-25%, or more than 25-30%, as examples. This figure may be applied to the upper rails 010, or the lower rails 005, or both.

Similarly on the lower rails 005, the rails are typically 0.120" wide at their narrowest permissible dimension and approximately 2.73" long. This creates an aspect ratio of 22.75. In accord with the present concepts, and the bolt carrier disclosed herein, this conventional ratio is altered by narrowing the width of the lower rails, or lengthening them, or both narrowing the width of the lower rails and lengthening them. This ratio may be increased from 22.75 by either decreasing the width of the rail, or increasing the length, or both.). Irrespective of length, the width of these rails may be reduced to less than 0.100-0.115", preferably less than 0.085-0.105", more preferably less than 0.060-0.090", and most preferably 0.050-0.065" or less. These rails, and other rails such as those above, may be continuous or interrupted in construction.

The inventor has determined that modification of the upper and lower aspect ratios in this manner decreases friction and improves performance. Ideally the aspect ratios will be increased by at least 1-10% and more preferably 10-25% or more. Further testing should result in gains of 25-50% or more depending on material compatibility. These ratios and other disclosed dimensions and aspects should be taken into consideration with maximum front and rear contact points regardless of whether continuous or in line or not. In other words the rail can be a single part or broken into multiple parts- and it may be in line, or it may be off line when these improvements and aspects are considered.

The leading 012 and trailing 007 edges of these rails typically have angles of 90° as compared to the carrier body. The carrier body, which may come in contact with the upper, buffer tube, etc. during operation has similar angles as well. This too creates drag and wear. In accord with at least some aspects of the present concepts, the leading and trailing edges of the upper and lower rails of the bolt carrier, and the leading and trailing edges of the bolt carrier body, disclosed herein, and optionally other rail edges, are beveled at an angle less than 90°, preferably 60°-89°, more preferably 30°-60°, and most preferably 1°-30° to reduce wear, lessen drag and enhance operation. It may also be radiused, chamfered, or otherwise improved in frictional resistance.

In yet additional aspects of the present concepts, the bolt carrier upward angle to the extant gas vent holes 022 is reduced below that of conventional bolt carrier specifications. The conventional bolt carrier "upper" vent hole 022 points upwardly from horizontal at approximately 45°. In accord with such aspects of the present concepts, this upper vent hole is lowered to preferably 30°-44.5° from horizontal, more preferably 10°-30°, and most preferably +10' to minus 20'. Likewise, the conventional bolt carrier "lower" vent hole 022 is currently 15° from the horizontal and, in accord with yet additional aspects of the bolt carrier in accord with the present concepts, this lower vent hole is lowered to from this convention position to between 5'-14.5° from the horizontal, and more preferably +5° to minus 10°. Holes between the upper and lower holes—whether in line, fore or aft are also improved with the disclosed dimensions. These modifications have been determined by the inventor to reduce the amount of propellant or exhaust gasses to which the operator is exposed and has the potential to reduce the firearm's firing signature.

In yet additional aspects of the present concepts, the upper and lower vent holes 022 are moved forward towards the front or rearward toward the rear of the carrier from their current 1.340" (hole center) position. Yet further, the holes 022 may be increased or decreased in size (from nominal 0.109" currently), changed in shape, staggered from current linear (vertically aligned) position, and/or changed in number from current position, size, and amount to promote better operation and venting. The extant vent holes may be moved rearward from current 0.109" nominal hole on 1.340" center (from carrier front) to permit better depressurization. Alternately they may be moved forward in the case of shortening of the bolt and bolt cavity as disclosed. They may be moved either way by 1-5%, more preferably 5-10%, and even more preferably 10-25% or more from a conventional TDP position, and may be increased or decreased in size as well.

Figure 1G:
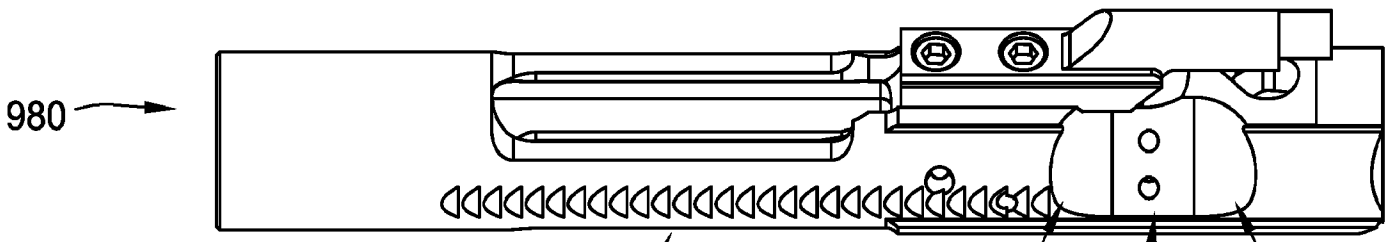
FIG. 1G (PRIOR ART)
Figure 2:
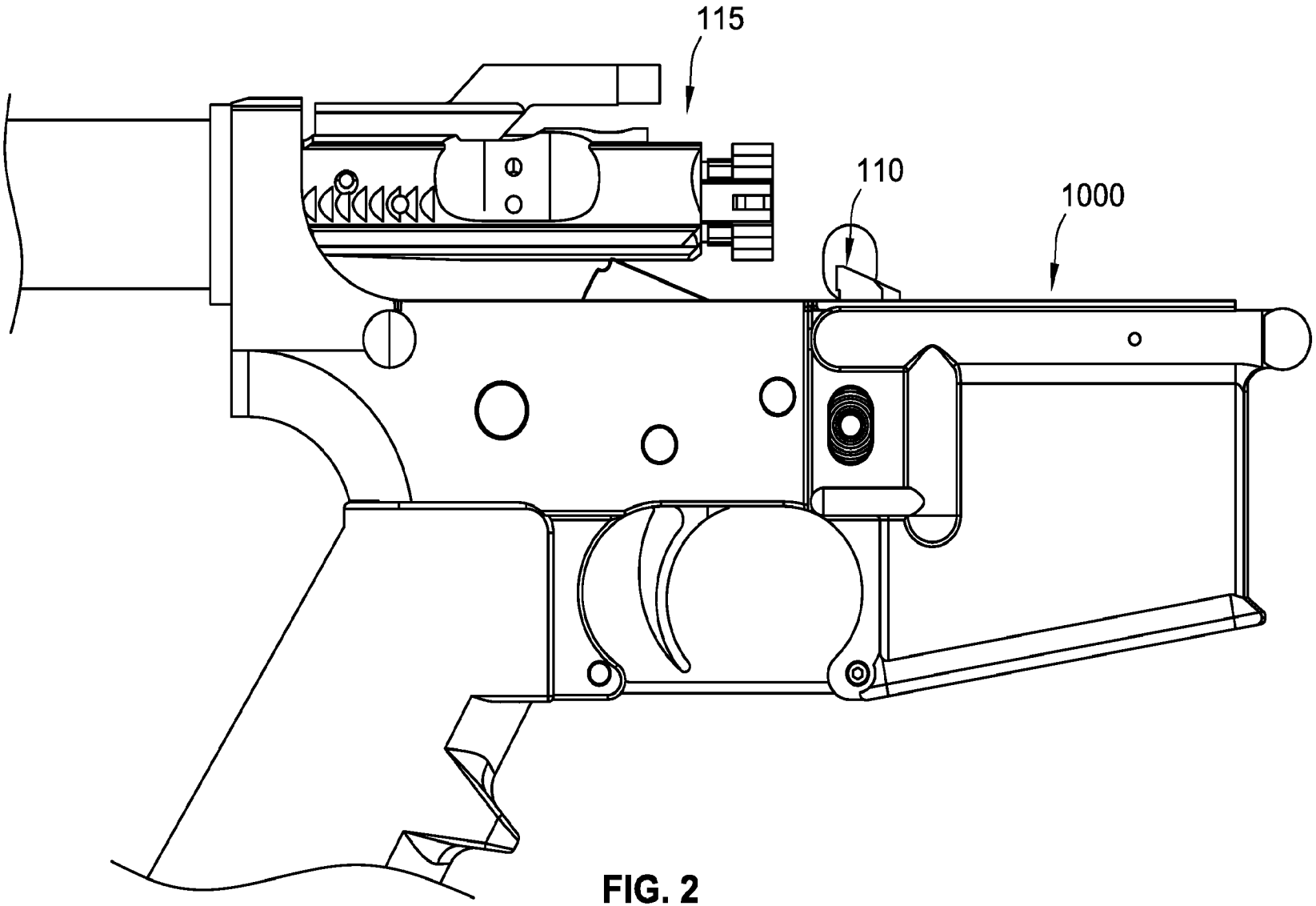
FIG. 2 (PRIOR ART)
FIG. 2 shows a conventional AR-15 bolt carrier 115 positioned normally in the lower receiver 1000, showing the relation of the bolt carrier to the hammer and receiver extension as well as the Bolt Catch 110.

These vent holes are found in an area of the bolt carrier commonly referred to as the "dust cover cutout" 30 FIG. 1G or dust cover pocket 30, or vent hole recess. This provides space for the dust cover to close, and it is opened upon firing by contact with the forward edge 33 of the cutout as it moves rearward. In accord with at least some aspects of the present concepts, this leading edge 33 of the dust cover cutout 30 of the bolt carrier 980 is moved rearwardly from the conventional position by 0.10"-0.50", preferably 0.30-0.60", and more preferably, with component redesign, by 0.50"-1.25". This modification helps to close off the extant gap that debris call fall into the upper receiver, and also opens the dust cover door more quickly, which has been determined to better vent gas.

As noted above, at least some of the present concepts provide a greater than normal stroke length. In order to maximize this disclosed stroke advantage, both the bolt and the bolt cavity (recess) of the bolt carrier may be further modified. For example, the cavity may be advantageously shortened, or pushed forward, to reflect changes in shortening the bolt and/or the gas hole (found atop the carrier body under the gas key when the key is installed) may be moved forward by as much as 0.460", with ranges from 0.050"-0.150", preferably 0.150"-0.250", and even more preferably 0.250"-0.460" possible. This provides advantages including, but not limited to, a longer stroke potential.

Barrel Extension

In accord with aspects of the present concepts, the angle of the feed path in the barrel extension (what the bolt locks into) is changed from the current TDP of 45° (for M4 barrel extension). The present inventor has determined that this feed path angle is steep enough to causes difficulties when feeding cartridges from the magazine. Further, bullet tips (e.g., ballistic tips) strike the chamber area, which causes drag and may damage match bullets, and in the use of combat loads (e.g., M855A1 round) the chamber can be damaged from projectile impact. Analysis by the inventor has shown that an angle of less than 45° not only works well, but also enhances feeding. Accordingly, in aspects of the present concepts, the feed angle is advantageously lowered from that of the current TDP to 37°-44.5°, more preferably from 30°-37°, even more preferably from 17°-30° or less. The "angle" refers to the number of degrees of the path that the cartridge needs to "feed" into the chamber. Similarly, this would apply for M16 version barrel extensions, and the like, which have a current TDP of 52°.

Additionally, in accord with other aspects of the present concepts, the width of the bolt lug openings in the barrel extension are changed from the current TDP size of 0.124+/−0.003. This permits the use of wider or thicker bolt lugs, as described above. Ideally these openings are changed from the TDP 0.127" maximum to 0.1275"-0.130", more preferably 0.130"-0.140", and most preferably greater than 0.140". This enables greater bolt lug strength and also enhances cycling and feeding.

Further, the lugged area may have the front or rear area changed from 90° edges to angled, chamfered, radiused, or otherwise reduced frontal area whether at the front or rear edge, which will promote better operation of the bolt lugs when going into and out of battery. In other words, if the Bolt is slightly out of battery when traveling forward, this angle will help guide the Bolt into battery. Similar changes to the leading edges of the Bolt Lugs are disclosed, and will help for the same reasons.

Further, the width of the "feed ramp" that the cartridge travels in may be increased by decreasing the space between the two ramps to the greatest extent possible, or eliminating it entirely as compared to TDP dimensions for the M16 or M4 Barrel Extension. Likewise, the outer edges of the same two ramps may be extended and made deeper to promote better feeding of cartridges from the magazine to the chamber as compared to TDP dimensions.

Changing these aspects will enable the bolt to be made stronger while still maintaining necessary strength on the barrel extension.

Cam Path

The cam path is the "slot" cut into the bolt carrier body in which the cam pin moves. The cam pin movement controls the movement of the bolt during operation. The cam path dictates how long a space and time the bolt unlocks during firing. It also dictates how smoothly or violently the firearm unlocks during firing. This violence or smoothness has a direct impact on how smoothly the firearm fires, as well as what forces are applied to the bolt lugs.

The prevailing and conventional thought is that unlocking of the bolt does not happen until the full, or nearly full, movement of 22.5 in the AR platform occurs. In the inventor's view, this is incorrect and the inventor considers this unlocking to actually take place much earlier. Experiments by the inventor on different firearms have shown that unlocking typically takes place at 16-20°, as opposed to the full theoretical 22.5° movement.

In view thereof, the cam path is redesigned in accord with the present concepts to improve performance. Essentially, when viewed from above, the angle of the path from rear left (locked position) to front right (unlocked position) should be more "straight" or in line with the direction of movement of the carrier, and less acutely "angled" as compared to the current Cam Path in the TDP which is found on most Carriers. This promotes smoother, better, and less violent operation. It also makes locking and unlocking easier in austere conditions when dirt, fouling or little to no lubrication are present.

In accord with the present concepts, the forces applied to the bolt lugs during firing is advantageously decreased, as are delays in the actual "unlocking" of the bolt, which thereby permits gas pressure to be advantageously lowered and which further eases extraction and minimizes the occurrence of broken extractors or stuck casings. These changes also results in less propellant gas being blown back into the action or into the operator's face.

In order to realize the above-noted benefits, the present concepts start the unlocking process sooner than is conventional. Other attempts to improve the carrier and cam path have fallen short because they delay the start of the unlocking, but do not "delay" the unlock so much as they compress the unlocking process, which dramatically increases the violence of part interaction. Thus, prior attempts to "improve" the situation have instead only exacerbated the problems of load on the Bolt and Lugs with severe rotational and other forces. Effectively, these prior attempts reduced the unlocking process space and duration by 50% or more, but dramatically increased unlocking and locking energy and force on the bolt lugs and other parts, which not only failed to delay the "unlock" but also causes major problems including broken lugs and bolts. This also causes problems in both locking (feeding cycle) and unlocking (extraction cycle) by effectively creating an overly steep "hill" that the cam pin must "climb" or move across. This becomes more difficult as the part becomes more fouled.

Figure 7D:
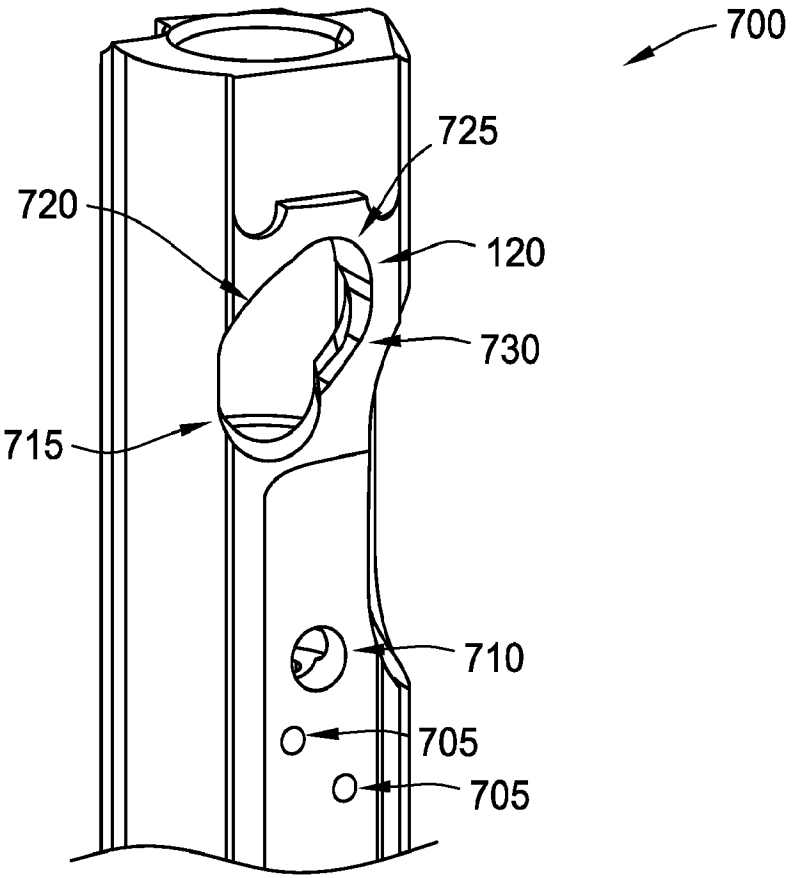
FIG. 7D shows an improved carrier cam slot/cam path 120 for an improved carrier in accord with the present concepts (gas key is removed for clarity to makes the path more visible), showing that the improved path starts the turn earlier and more gradually as the carrier moves forward.
Figure 7C:
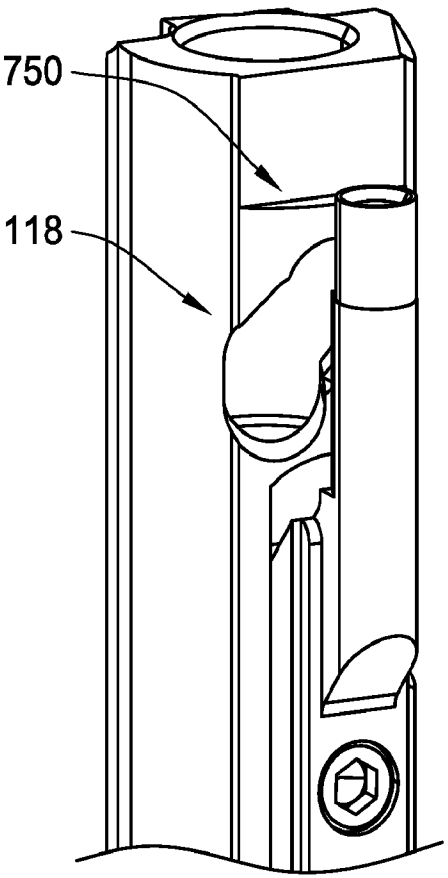
FIG. 7C (PRIOR ART)
FIG. 7C shows a conventional carrier cam slot/cam path 118 (partially obscured by gas key).
Figure 7E:
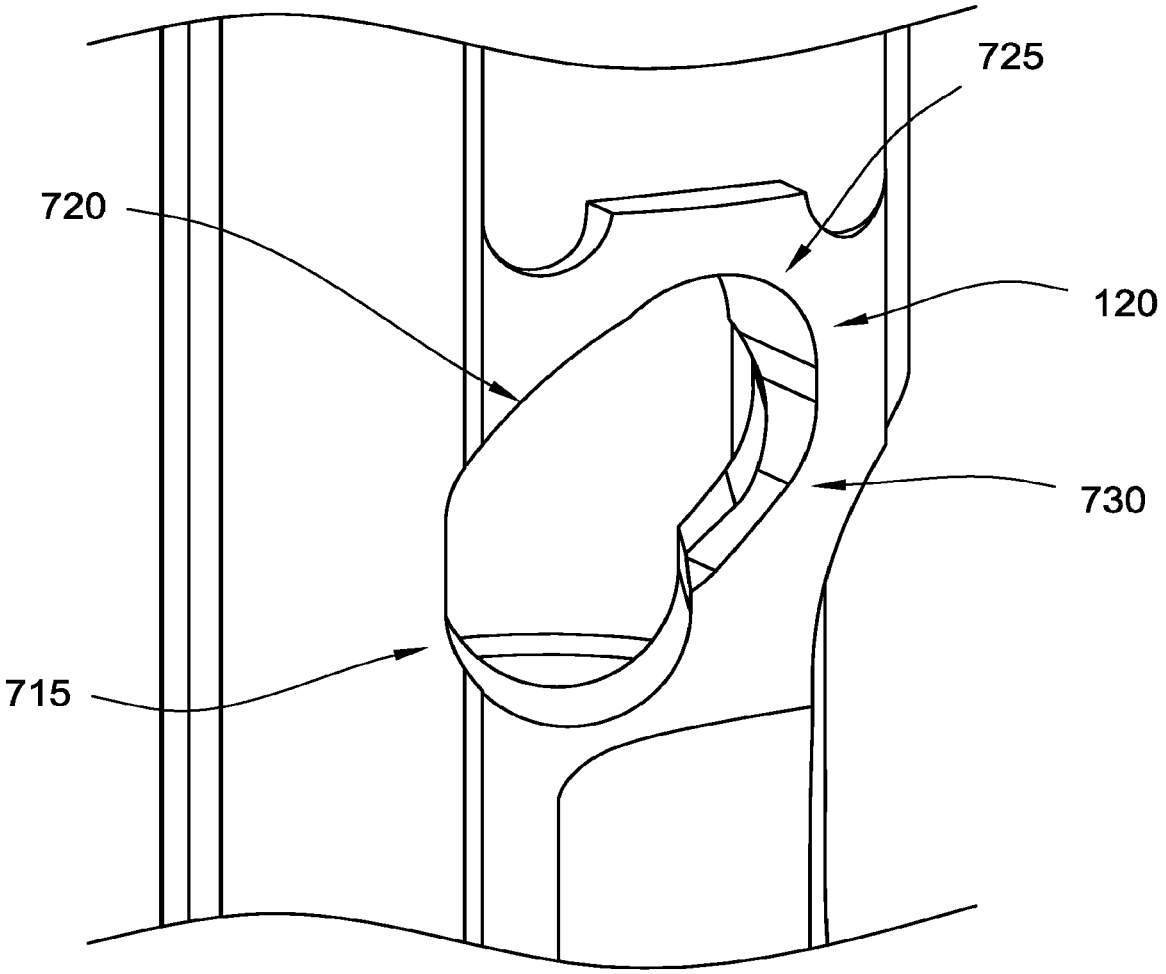
FIG. 7E shows an example Improved Cam Path in accord with at least some aspects of three present concepts.

As shown in FIG. 7D, for example, which shows a prototype carrier in accord with aspects of the present concepts with the gas key removed for clarity (showing the bolt holes 705 and cavity hole 710), the profile of the opening is changed with respect to the TDP opening of FIG. 7C to spread those actions and forces over time, resulting in a >10% delay in actual bolt unlock, and increases the "unlocking" process space and time >22%. In accord with the present concepts, the improvement of keeping the Bolt "locked" after firing, before extraction begins via unlocking, is a major enhancement, as much as 1-10%, and preferably between about 10-20%, or more, is desirable and is disclosed. Spreading out the "unlocking" process over the longest available time and space is likewise desirable, and improvements of 1-10% or more, more preferably 10-20% or more, and even more preferably between about 20-35% or more are expressly included within the concepts disclosed herein. By extending the available length of the Cam Path travel these may be similarly extended. The change in the ending position of the Cam Pin closer than the TDP position of 0.640" is reiterated here and may be used with any of the methods or techniques disclosed herein.

The decrease in "dwell" to initiation of unlocking is disclosed here as follows. The start of the unlocking process begins at least 0.005"-0.010" earlier, preferably 0.010"-0.030" earlier, more preferably 0.020"-0.060" earlier.

Coupled with this is the delay in the unlocking to 16-20° by at least 0.005"0.010", more preferably 0.010-0.030" or more, even more preferably 0.025"-0.060" or greater, and most preferably 0.040"-0.080" or more. In at least some aspects of the present concepts, the path can be extended forward on the furthest forward point by at least 0.005"-0.010", or preferably by 0.010"-0.020" or more, even more preferably by 0.020"-0.030" or more, and most preferably by 0.030"-0.045" or greater.

The improved Cam Path reduces, or ideally eliminates the "pocket" 725 which is meant for "dwell" at the end of the unlocking (or beginning of the locking stage, viewed another way). This creates a more or less continuous cycle of movement of the Cam Pin within the Cam Path 120. It promotes smoother, more reliable locking and unlocking. This "pocket" 725 for dwell is found at the forward portion of the Carrier in the extant Cam Path.

Expressed other ways, the "locked" dwell 715 can be reduced to less than the current 0.070" or so per TDP. It may be reduced to 0.060-0.0695" or less, or more preferably, 050-0.062" or less, and even more preferably from 0.037-0.052" or less. This may also be taken as a percentage of total given a base length of cam travel of 0.325"

Alternately, the "unlocked" dwell 725 can be reduced to less than the 0.042" or so called for in the TDP. This may be reduced to 0.030-0.0415" or less, or preferably 0.025-0.031" or less, even more preferably 0.015-0.027" or less, and most preferably 0.002-0.015" or less. Likewise this may also be taken as a percentage of total given a base length of cam travel of 0.325".

The corresponding space for the "locking" 730 and "unlocking" 720 movement of the Cam Pin can be expanded beyond the 0.213" or so called for in the TDP. This may be increased to, 214-0.230" or more, or preferably 0.228-250" or more, or even more preferably to 0.245-0.265" or more, and most preferably to 0.265-0.275" or more. When the Cam Path is extended beyond 0.325", corresponding changes in the locking/unlocking movement are also disclosed. In addition to specific figures, corresponding percentages may also be applied to the disclosures herein.

The "camming" surfaces 720 and 730—the lock 730 and unlock 720 portions—may be parallel, or they may move asymmetrically away or toward the other. They may be radiused beyond what is called for in the TDP, or otherwise chamfered or beveled to reduce the contact area between the Cam Pin body and the Cam Path. Any technique to reduce these contact areas is disclosed without limitation.

This can be done by shortening the "shelf" 750 part of the carrier where the charging handle sits, or the charging handle can be reduced in this dimensional area to accommodate this as well. When this is done, the movement rearward of the extractor pin, which holds the extractor in the bolt, is disclosed. This prevents the possible "walking out" or falling out under sustained use and fire, of the extractor pin 673. The Bolt FIG. 1B may extend further forward than the 0.640" position while still providing coverage of the extractor pin within part of the Carrier, which is desirable to avoid possible loss of the pin and extractor while firing. This movement may be between 0.005-0.045" as explained previously. The similar rear movement of the extractor pin keeps it within the bolt recess on the carrier, which enhances reliability as well as Cam Path travel.

On piston operated firearms, the key equivalent (or strike face or tappet) can be relocated to this area by the charging handle shelf which is ahead of the cam path. This enables the longest stroke possible.

The cam path improvements disclosed above cover the AR-10, AR-15, and M-16 series of firearms, but these concepts may be extended to alternative configurations of firearms.

Depressurization Port—Bolt Carrier

In at least some aspects of the present concepts, one or more depressurization ports are configured and disposed to relieve the gas pressure within the Stoner FOW (Family of Weapons) bolt recess within 80-100%, or more preferably 60-80%, or even more preferably 40-60%, or even more so within 10-40% of maximum pressure of the expansion (bolt acts as in-line piston or cylinder within "bolt recess" of bolt carrier which acts as a cylinder to said bolt).

Conventional exhaust ports allow 80-90% or more of pressure relief from maximum "bolt recess" pressure before any exhaust exits at all. They are not designed to relieve the pressure in the combustion process, which makes the operation of the firearms in question more forceful and violent than necessary. This causes, in addition to aforementioned problems, gas to "blow by" the gas rings on the bolt which causes unnecessary and undesirable fouling and wear.

These conventional exhaust ports are not designed to depressurize the operating components of the firearm. In accord with aspects of the present concepts, the disclosed depressurization ports, disposed in the bolt carrier in some aspects, or alternately in other aspects in the gas key, gas tube, or other functional components of the firearm, are specifically configured and disposed to drop, cap, or otherwise reduce the maximum peak pressure of the bolt recess below that of conventional designs. This reduction in peak pressure has been determined by the inventor to unexpectedly optimize the cycle of operation, especially when running higher pressure ammunition, firing suppressed (which tends to increase "back pressure" or gas pressure), or shorter length gas systems (where the gas tube is shorter than originally designed).

Bottom Area—Bolt Carrier—Both AR-15 and AR-10

In at least some aspects of the present concepts, the bottom portion 122 FIGS. 3C and 123 FIG. 3A of the bolt carrier is reduced immediately below the bolt recess 125, which comes into contact with the loaded rounds in a magazine when the magazine is inserted into the firearms. The current dimension of the AR-15/M-16 carrier, from charging handle cutout to bottom of carrier is a nominal 0.765" per TDP. In accord with these aspects of the present concepts, this dimension 127 is reduced to a minimum of 0.760" or less, or more preferably a minimum of 0.755" or less, or even more preferably less than 0.755" to as little as 0.725-0.755 or less. This dimension may be as small as about 0.585" to 0.725".

On the AR-10, this same dimension is 0.938", and in accord with like aspects of the present concepts, this dimension is reduced to a minimum of 0.933", or preferably less than 0.932", or even more preferably less than 0.927". In at least some aspects of the present concepts, this dimension may be as small as about 0.710".

These dimensional changes will reduce friction of the carrier across rounds of ammunition located in the loaded magazine, and enable easier loading of loaded magazines into the firearm when the bolt and carrier are forward. In present art, this is problematical with fully loaded magazines which can be difficult to properly load and seat. This also causes unnecessary friction in normal cycling of the firearm which can contribute to short stroking or failure to complete the cycle of operation in normal firing, especially in austere conditions. These dimensions may be reduced by 1-5%, more preferably 5-10%, even more preferably 10-20% or more as well as compared to TDP dimensions.

Essentially, on an AR-15, the bottom portion described above can be reduced by 0.002"-0.010", more preferably 0.010"-0.025", even more preferably 0.025"-0.060", and most preferably as much as 0.050"-0.085" from current dimensions when comparing this area of the carrier to TDP dimensions. This can be measured from the charging handle "shelf as described above, or from the bolt cavity of the carrier, etc.

This part of the Carrier may also use flutes, arches, angles, grooves, depressions, sand cuts, ridges, or other techniques to reduce the contact or surface areas that result in greater friction when the firearm fires.

Gas Vent—AR-10.

In at least some aspects of the present concepts, gas exhaust vents on the AR-10 et al. FOW are moved and/or added from the current location (at least 1.465" from the front edge of the bolt carrier body) to aft of that location. While aft of that location, the gas exhaust vents in accord with the present concepts are disposed to be forward of the extant hole that is at least 2.025" from the front of the carrier.

This distribution of gas exhaust vents may better vent exhaust or propellant gasses during firing and will contribute to smoother, cleaner, more reliable operation.

These ports or vents may be arrayed in their current "vertical" (straight up and down relative to the firearm) orientation, or they may be arrayed diagonally or otherwise randomly to take full advantage of the disclosed inventions. They may also be round, or they may be other, non-standard shapes that take full advantage of the disclosed inventions. This applies to the 5.56 mm, or 7.62 mm, or any other calibers using the "expanding gas" method of operation.

Carrier Clearance from TDP on Upper Receiver

Figure 8:
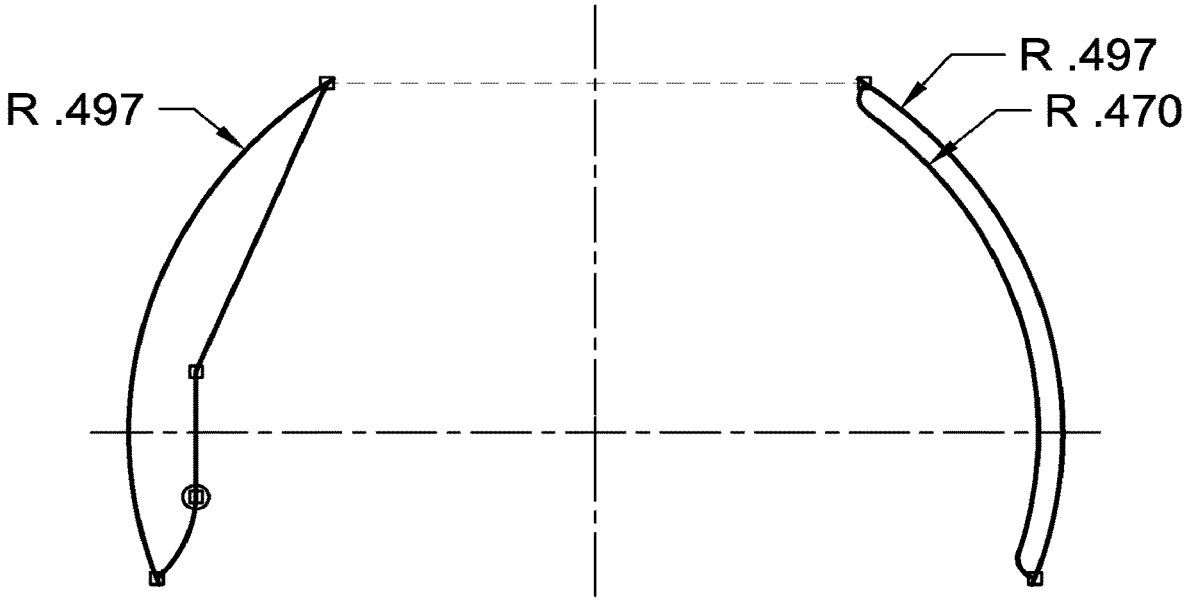
FIG. 8 shows increase in clearance between surfaces of carrier body and receiver, with the left image showing the clearance volume between an upper receiver and one embodiment of a bolt carrier in accord with aspects of the present concepts as compared to the clearance volume between an upper receiver and a conventional TDP M4 bolt carrier (right image). The carrier in accord with aspects of the present concepts has 0.49 cubic inches, more than double the volume, that that of the M4 carrier (0.23 cubic inches).

Current TDP specifications show a carrier clearance volume of about 0.23 cubic inches between the outer surface of the conventional bolt carrier "supported" area, dictated by touch points or contact areas of the carrier, and the inner surface of the upper receiver. In accord with at least some aspects of the present concepts, this carrier clearance volume is reduced, such as by reduction of one or more dimensions of one or more portions of the carrier in the "supported" area, to thereby increase this "clearance volume" in order to enable better operation in austere conditions. In at least some aspects of the present concepts, either singly or in combination with the aforementioned reductions in carrier clearance, relief cuts are formed in the appropriate areas of the upper receiver to increase this same "clearance volume," as represented in FIG. 8, nearly doubling the clearance between the receiver and carrier (e.g., 0.49 cubic inches for the carrier in accord with aspects of the present concepts (left image) vs. conventional M4 clearance volume (right image)), which promotes better, more reliable operation in austere conditions.

The use of greater carrier clearance with greater support from longer rails is explicitly disclosed. By way of example, in accord with at least some aspects of the present concepts, the upper rails are longer than 2.42" and the lower rails are longer than 2.73".

Increasing the "clearance volume" between the carrier and related components and the receiver and related components (which may, for example, include the buffer tube) will enable better, more reliable operation of the firearm in austere conditions.

USE OF FORWARD ASSIST CUTS with REDUCED CARRIER—the use of forward assist cuts in a reduced size or increased clearance Carrier is disclosed as shown in FIG. 3A (TDP is shown by comparison in 1G). This permits full functionality even with increased clearance carrier bodies.

LOW DRAG CROSS SECTION—the reduction in cross section FIG. 3B 130- or metal to metal contact areas of the components—when viewed from the front or rear of the Bolt Carrier Group (Bolt, Bolt Carrier, and components including the Gas Key and Cam Pin) and Buffer are explicitly restated. This can be compared to the TDP cross section shown FIG. 1D 14 The reduction in critical aspects of these components to reduce drag and promote stable, reliable operation especially in adverse circumstances is further restated. These components will have their contact areas reduced by 1-10%, preferably 9-25%, even more preferably 24-50%, and most preferably by 45-65% or more. This will provide the smoothest and most reliable operation of the gun by supporting the parts in operation but reducing the undesirable "drag" or friction, especially in adverse conditions. Additional clearance is created to lessen the possibility of malfunctions caused by debris or fouling. Consistent resistance in the recoil and counter recoil stages of operation will be provided by the lessened friction from the Low Drag parts.

Buffer

In accord with aspects of the present concepts, buffers are provided that create more stroke or travel as stated previously than the approximate conventional TDP 3.75" of stroke when supported by the physical limitation of the carrier, which is typically the gas key or equivalent, coupled with the Buffer.

With "carbine" length systems (nominal 7" buffer tube), a standard length buffer is 3.25". An AR-10 carbine buffer is 2.5" long, and it permits catastrophic over travel if used in an AR-15 (i.e., the carrier can "fall off the hammer and the hammer can fall forward of the bolt and carrier, which will lock up or disable the firearm).

In contradistinction to these conventional components, the present concepts provide buffers having a length greater than 2.60" and shorter than 3.10"-3.20" in use in carbine systems (with nominal 7" buffer tubes) to provide additional stroke capability. Stated differently, the length of the "stroke" (3.75" TD, greater than 3.75" in accord with aspects of the present concepts) plus the length of the "buffer" (3.25" TDP, less than 3.25" in accord with aspects of the present concepts) should equal 7.00" (for the configuration discussed above) approximately given allowances for tolerances, etc. in carbine systems. Similar adjustments are claimed for other systems whether "rifle" length, "A5" length, or otherwise that promote travel greater than otherwise possible. This increased stroke can be as little as 0.050-0.330" or less, and as much as 0.300-0.350" or more, and preferably 0.350-0.390" or more, and more preferably by 0.390.420" or more. With component changes described previously, this may be increased to 0.420.650" or more.

Reduction of the Buffer is made possible by compressing the component parts as stated, as well as reducing the internal "pad" (that is the pads between the sliding weights) dimensions to less than their current 0.075" nominal thickness to as littles as 0.010-0.040" thickness, and reducing the pad number from the same as the number of weights (varies by system, 3 in conventional carbine length buffer, 2 in AR10 carbine buffer, etc.), or using a single pad, or eliminating them entirely.

The Buffer "pad" may be reduced in dimensions versus the TDP—0.400" external size and 0.473" internal size to support this, as can the pin or rivet securing the pad to the Buffer body. The Buffer body may be reduced commensurately to the "internal" pad change—this concerns the part of the internal Buffer pad that is inside the Buffer body.

The Buffer may have other dimensions changed to still permit the use of specified TDP weights while permitting shorter overall length thus providing additional stroke.

Additional benefit can be gained in both travel and shock absorption by using 2 (two) or more densities as measured by Durometer in the Buffer Pad. This may be a single unified piece or it may involve affixing another material to the Pad.

Extended stroke is possible using the aspects stated herein, and with carriers that permit extended stroke.

Figure 9A:
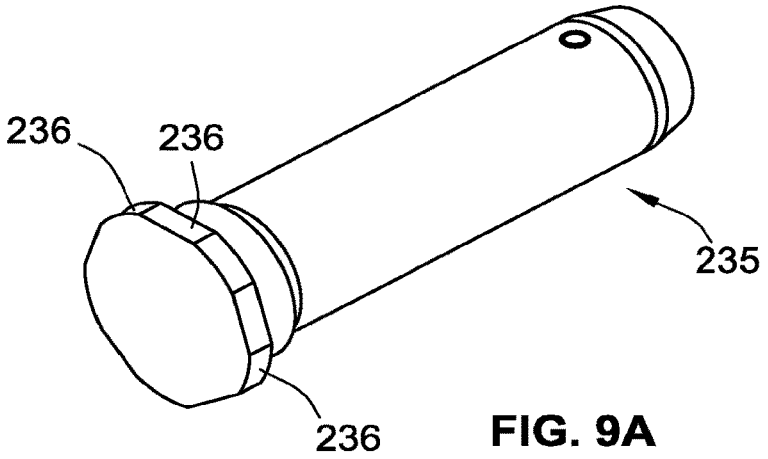
FIGS. 9A-9B show isometric and cross-sectional views of a buffer assembly in accord with at least some aspects of the present concepts, showing a shorter buffer 235 that can be advantageously coupled with the carrier/key improvements disclosed herein to enable a longer stroke. The 5 flat surfaces 240 shown provide less drag due to fewer or smaller touch points, about 30% less contact surface in this embodiment as compared to a conventional TDP buffer.
Figure 9B:
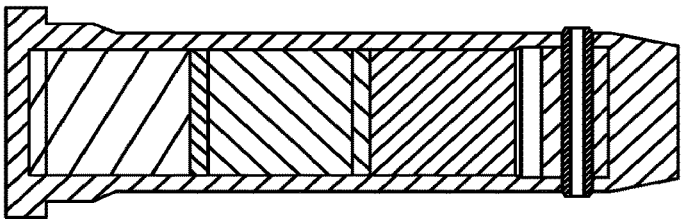

Additionally, disclosed herein is the use of more than 3 "flats" or more than 3 "radii" on the forward most portion of the buffer ("Buffer Face"). As one example, the buffer assembly 235 of FIGS. 9A-9B shows five flats 236. Also, compared to permissible TDP dimensions of 0.326", the flats may be increased in length to 0.327-0.379" or more, and the radii may be decreased in length to less than 0.689-0.698". The use of increased length of "Flats", or more than 3 "Flats" serve to decrease the contact area or drag of the Buffer by 10-25%, or more preferably by 25-50%, or as much as 50-70% or more when moving within the buffer tube. As the number of Flats increases the size or length of each flat will decrease to less than TDP size. All these measures serve to reduce contact friction and drag. This enables more consistent and reliable operation of the firearm, especially in austere conditions.

The Flats may also be made as long as possible to decrease drag. Additionally, the radii may be made shorter or smaller to decrease drag as they are typically the portions of the Buffer that are in contact with the Buffer Tube.

Increasing the Flats from 3 (present) to more than 3 (5 shown in the drawing) reduces the part of the Buffer that may contact the buffer tube from 68% to 47%. Thus lessing the contact portion from 68% or 246 or so degrees is disclosed to reduce the drag or contact surface and improve operation.

An extended "pad" or spacer or similar device may be used on a small (e.g. 2 weight) buffer, or on a longer buffer tube to optimize components to create greater stroke.

Buffer Tube

In accord with other aspects of the present concepts, buffer tubes are adjusted in conjunction with changes in buffer size to increase stroke capacity of greater than 3.75" nominal movement (subject to "tolerance stacking", etc.). Additionally, a shorter buffer tube could be used with a short buffer to get the conventional TDP stroke (3.75"), or it could be adjusted to provide longer stroke. For example a 2.50" AR 10 buffer could be used with a 6.25" nominal buffer tube to yield a standard 3.75" stroke capacity, and so forth. Alternately, a 3.25" buffer could be used in a 7.25" buffer tube to provide 4.00" stroke capacity, as another example.

In accord with other aspects of the present concepts, the carbine buffer is honed beyond the currently specified depth of 4.00", and to a better surface finish than 120 RMS, to reduce friction and corresponding drag in cycling.

Charging Handle

As seen in FIG. 1, conventional firearms in the Stoner FOW include a charging handle 32. The charging handle 32 engages the bolt carrier 26, and when pulled back, pulls the bolt carrier 26 to the rear and cocks the hammer 66. Allowing the charging handle 32, along with the bolt carrier 26, to move forward, strips the top round from the magazine and loads the round in the chamber. Thus, pulling back and releasing the charging handle 32 on a fresh magazine loads the first cartridge from the magazine. The actuation of the charging handle is also necessary when a cartridge fails to fire. Pulling back and releasing the charging handle ejects the problem cartridge and loads a new one from the magazine. The charging handle 32 may have a latch 62 that is biased inwardly by a spring 64, thereby maintaining the charging handle 32 in a locked position. When an operator applies force to the latch 62, such as in a pivoting manner, in order to overcome the spring force of the spring 64, the latch 62 disengages, and the charging handle 32 is free to be pulled toward the rear of the firearm.

Related art charging handles, such as the charging handle shown in FIG. 1, typically have several problems. Notably, during operation of direct impingement type firearms, such as an AR-15, gas is exhausted through available spaces. One of these spaces if formed between the charging handle and the upper receiver. Thus, when related charging handles are used, exhaust gas escaping through the space between the charging handle and upper receiver blows directly toward the operator's eyes. Another problem with related art charging handles is that the latch may extend from the left side of the charging handle and be actuated by pushing toward the rear of the handle. The amount of force applied to the latch in high stress situations can be excessive. Applying this force to the latch in the manner required by related art charging handles puts significant strain on the charging handle body, and can cause the charging handle to bend or break within the firearm.

In accord with at least some aspects of the present concepts, changes are made to the charging handle ("CH") in the Stoner FOW. Specifically, the top contact portion of the CH is made to be wider than 0.110" and/or longer than 0.110" (conventional spec dimension is 0.100"). Additionally, in accord with at least some aspects of the present concepts, the CH body is made to be wider than current nominal 0.400" or maximum 0.405" in the portions which may come in contact with the upper receiver. Further, in accord with at least some aspects of the present concepts, the portions which may come in contact with the upper receiver are made narrower than the current 0.400" nominal or 0.395" minimum.

In accord with at least some aspects of the present concepts, the total contact surface between the receiver and the "side contact" portion of the current spec CH is decreased so as to be less than 0.228" high, and the top and bottom contact dimensions of this same area greater than 0.228" apart in the "side contact" portion of the charging handle that comes into contact with the upper receiver CH "slot", a milled cut that is 0.406"-0.410" wide. In addition to lessening the contact areas of the CH from top to bottom, these may be increased from TDP dimensions as well. This innovation directly addresses the high level of friction between the charging handle and the upper receiver encountered in conventional spec designs, as this area gets very heavily fouled and impedes the movement of the carrier, which impacts the "timing" or proper operation of the firearm.

In accord with at least some aspects of the present concepts, interrupted or irregular surfaces are provided on this same outer contact area via raised pads, recesses, skids, etc. or a combination or raised pads and recesses, sand cuts, etc. to receive fouling or other debris.

Various other methods of reducing contact surface are disclosed to include rails, grooves, dimples, sand cuts, and all other possible variants to reduce friction and increase stability.

Alternately in this charging handle underside rear area, brass, copper, or other suitable applique layers, tape, etc. in a suitable thickness (e.g. 0.001"-0.010", more preferably 0.010"-0.030", most preferably to 0.025"-0.120" or more may be added to help block gas flow out of the receiver and into the shooters face. This can impair eyesight and also result in exposure to acrid fumes.

Figure 10:
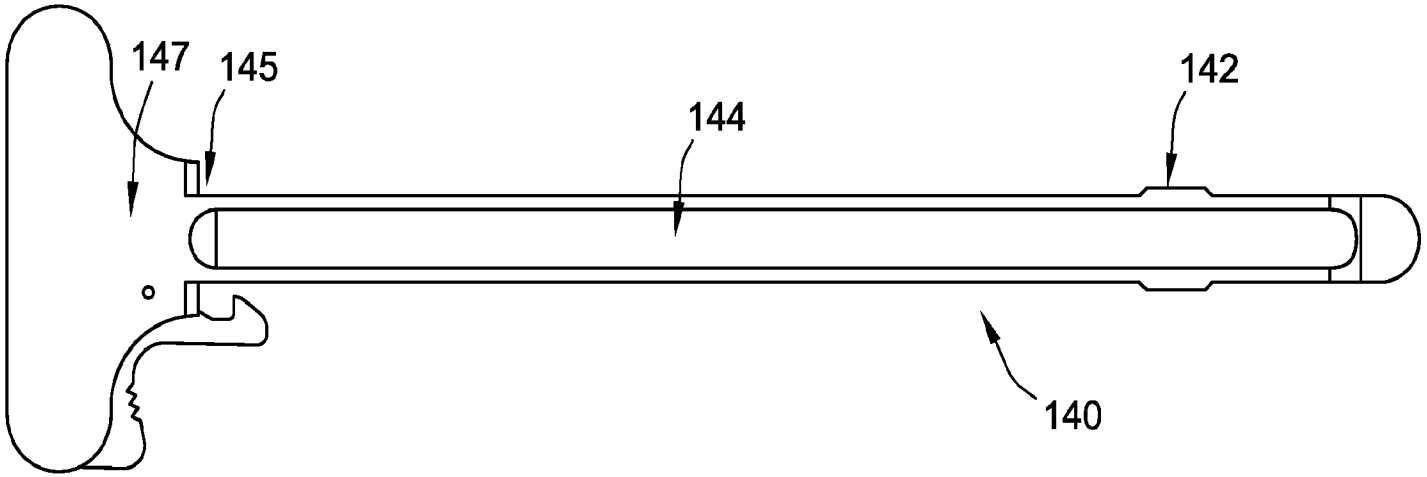
FIG. 10 shows a conventional charging handle. The image of the charging handle shows "tabs" 142 which should be moved forward in accord with at least some aspects of the present concepts to improve for stability and movement. The charging handle cutout 140 rear 145 shows the area that should be removed in accord with at least some aspects of the present concepts.

The underside portion of the charging handle FIG. 10, which forms a slot 144 for the gas key or equivalent, and which limits possible gas key travel, is milled out or otherwise relieved or omitted at its rearward position 145 in order to increase maximum stroke of the firearm in accord with aspects of the present concepts. From TDP dimensions of approximately 6.06" from front to rear most point of milled area, this area 147 at the underside portion of the charging handle may be reduced by (e.g., by milling, forming, etc.) at least 0.050"-0.125", more preferably 0.125"-0.200", even more preferably 0.200"-0.400", and most preferably 0.400"-0.550" or more. The reduction in this area permits a longer stroke due to the additional travel afforded the gas key "slot" 144 (or equivalent) or recess that the Gas Key and the optional increase in the thickness of this area may advantageously block gas flow out of the receiver into the operator's face.

Additionally, the movement forward of the outer "tabs" 142 which ride in the milled slot of the upper receiver, may be moved forward towards the front of the charging handle to the greatest extent possible in order to better stabilize the charging handle. It can also serve to increase the movement of the bolt carrier when the "stroke" is extended to the maximum extent possible. The current TDP position of approximately 0.950-1.00" depending on tolerance and configuration of these tabs limits rearward movement to about 4.00-4.20", and with modifications great rearward movement of the carrier is possible. These tabs can be moved forward 0.010"-0.250", more preferably 0.225"-0.600", even more preferably 0.550"-0.875", and most preferably 0.825"-0.925". With movement forward, the charging handle can be used to the full extent of the range of travel with Extended Stroke components.

Alternately the "slots" milled into the upper receiver for the "tabs" may be milled out to provide greater movement for the charging handle.

All of this is made with the goal of better functioning in austere environments.

Barrel Profile-Slab

In accord with at least some aspects of the present concepts, 2 or more "flats" are milled into, or otherwise formed in, the barrel which serve to increase barrel stiffness and resistance to flex, especially vertical "barrel whip", for a barrel of a given weight and length.

This enhancement is directed to center fire rifles, carbines, crew served and individually fired weapons, whether bolt action, semi-automatic, select fire (semi or fully automatic), or fully automatic. This enhancement is directed to AR-15, AK, and other "assault pistol" style firearms under current regulations.

The "flats" described above are milled on (or otherwise provided on) the barrel for a length of at least 5%, and preferably at least 10%, and most preferably at least 25% of the total length of the barrel. This is opposed to conventional barrel "flutes" which are cut deeply "into" the barrel in order to cut weight from the barrel. The issue is that the flutes, in order to remove meaningful weight, cut very deeply into the barrel—far more so than the flats disclosed here. By cutting deeply into the metal, the flutes weaken the metal in sustained, high volume fire—which is more typically found in semi-automatic and automatic fire. When the thin spots caused by deep flutes are heated, they will burst before the thicker portions of the barrel that are not fluted. The "flats" approach avoids this and enables the removal of more metal to lighten weight without sacrificing barrel strength or rigidity. This is further opposed to conventional "heavy" barrels (e.g., 0.750" in diameter forward of the gas block) or "bull" barrels (e.g., 0.920"-0.936" in diameter forward of the gas block), which merely increase the barrel diameter (and mass) to enhance heat transfer and to minimize barrel distortion, particularly for applications where multiple shots are taken in rapid succession.

In accord with at least some aspects of the present concepts, the "flats" are at least 5% of the overall size or diameter of the barrel, and preferably more in terms of their size relative to the width of the barrel. In other words, and example size 0.750" barrel would have a "flat" of 0.0375" with a 5% sized "flat". More preferably, the "flats" may be between 5 to 15% or, even more preferably over 15% to 50% or greater. This may run as much as 50-70% of the size, or even 70-90% of the size, driven by considerations such as outer barrel dimension as well as bore diameter. This disclosure applies to whatever portion of the barrel is in consideration, recognizing that many may vary in size, taper, or otherwise change dimensions along its length.

The "flats" may run on the side, or other portion of the barrel. They may be tapered or parallel to the bore. By tapered, this generally means providing more thickness to the barrel towards the chamber, and less towards the muzzle as pressure decreases.

This is especially important when suppressors are affixed to the end of the barrel of a particular firearm due to the dramatic increase of weight at the end of the barrel, making barrel whip, especially vertical whip, an important problem to overcome.

Finite Element Analysis (FEA) performed by the inventor showed that a barrel using these techniques can maintain weight within 2% of a light M4 Barrel (standard profile, not heavier SOCOM profile) with 98+% stiffness of a considerably heavier 0.750" thick barrel. Thus an operator can have a light barrel with the stiffness of a heavy barrel, which has advantages for portability and firearm handling for hunting, combat, competition, etc.

Hammer

In accord with at least some aspects of the present concepts, the hammer may be modified in such a way to permit the extended bolt catch disclosed herein to function and still permit the hammer to operate normally. To accomplish these simultaneous goals, a slot or opening is formed in the hammer that corresponds to applicable rearward movement of the back end of the bolt catch.

Additionally, the hammer may be made "taller" to the greatest extent possible in order to support the bolt carrier in extreme improved "stroke". For example, the height of the charging handle recess of the upper receiver, which will allow >0.400" of extension "support," can be envisioned when an imaginary line is extended rearward on "max carrier travel" where the carrier is about to "fall off" of the hammer. It may also have contact surfaces between the hammer and the bolt carrier improved in such a way that they are "longer" or extend further aft when in the "cocked" position. This too supports the carrier when in improved or "extreme" stroke, in the rearward position.

Cuts in Piston—Non-Transverse

In addition to the modifications to the AR-15 bolt described previously, the present concepts also include the use of non-transverse features (e.g., cuts or indentations, grooves, flutes, fouling cuts, etc.) to create a lower friction surface on piston operated firearms. These features may be on the piston, or cup, or the gas block, or gas regulator, or any similar part of piston-operated firearms. These features will serve to reduce drag of the parts when in motion, especially in adverse conditions as they come into contact with other material parts of the gun.

It is noted that some conventional firearms, for example the AK-series of firearms and equivalents (e.g., AK-47, AK-74, AKS-74U, AK-100 series, AK-12, etc.) or generally Kalashnikov rifles, as well as other known firearms of various types, have utilized cuts in pistons, but such cuts have been transverse. This includes belt fed machine guns such as the M60, M240, SAW, PKM, MK48, and other variants. This does nothing to reduce the drag on the parts, defined by cross sectional exposure, when in motion as such motion is fore and aft or longitudinal. Thus, transverse cuts (90° to direction of movement) do not provide useful assistance in reducing drag fore and aft. In contrast, in accord with the present concepts, the disclosed non-transverse features, preferably close to or approximately in line with the movement of the parts in question, do help to reduce such drag by reducing material surface-to-surface contact, especially as measured by cross-sectional exposure that have the greatest impact on longitudinal movement, which is the movement that occurs during cycling. These non-transverse features provide a place for fouling or debris to collect while reducing the "frontal" or exposed surface contact area, thus reducing drag and ensuring more consistent and reliable operation.

Optic Reticle

In the current range of fielded optics for competition and combat use, there exists the need to deliver rapid, accurate fire on close to mid-range targets. These targets are typically small, 3-6 minutes of angle (MOA) and often moving.

Current optics are usually set up with either a simple "red dot" lacking any ranging or holdover features, or have a huge amount of stadia lines which can be quite useful for ranging targets or engaging very distant targets. They are less useful for rapid, accurate fire on small and dynamic targets. Often, the red dot itself (which may be of different sizes such as, for example, 4 MOA) obscures the target, particularly at range.

In accord with at least some aspects of the present concepts, an optic is provided with inwardly curved lines, curves, angled lines, or straight lines with ends that curve inwardly, where the top and/or bottom portions are narrower than the portions in between the top and bottom. These will be referred to herein as "brackets". These brackets may also curve outwardly wherein the middle portion is narrower than the top or bottom ends.

These brackets can vary in distance as desired to help with target holds on moving targets (e.g. 16 MOA, for example). The brackets surround an aiming point that is generally free of lines except for the minimum possible vertical downward and horizontal lines to help with orientation and holdover.

The brackets may optionally have additional brackets on the horizontal plane if beneficial for the desired usage, such as when variable power optics (e.g. 1×-6×, 3×-18×, etc.) are used and an aiming point for moving targets may be useful across a range of power settings. This is particularly true when using optics with a reticle, which changes in size with magnification.

These brackets can be basically thought of as a "combat horseshoe" reticle without the top end of the circle. In the "combat horseshoe" reticle the top portion of the circle is closed, and some portion of the bottom portion is open. Using a 360 degree circle, as an example, the top may be open to any degree as desired, for example from 350-10 degrees, or alternately 340-20 degrees, or even 330-30 degrees, and even 320-40 degrees. The "topless" reticle may extend, for example, to the horizontal line at 250-90 degrees, or even beyond it to 230-110 degrees. In at least some variants, the brackets can be, without limitation, curved, angled, straight, etc., or combinations thereof. The commonality is that the top of the bracket is ideally curved inwardly but may be left open entirely on the top end. Likewise the bottom portion is curved inwardly at the bottom end. The bottom portion may be either open or closed.

One or more vertical stadia lines optionally, but preferably, extend downwardly and also upwardly as desired to assist with range estimation and holdover. In some aspects, the vertical stadia line(s) may extend down any distance, but will ideally have markings to 10-12, or even 12-15 mil (milliradian, approx. 3.6 MOA) on the vertical- or other measures including MOA may be used. Similarly, one or more horizontal stadia lines may extend to approximately half of this distance of the downward vertical stadia line(s). Optionally, the lines may be thin towards the middle and thicker towards the outer portion of the reticle.

The visually open nature of this reticle will permit rapid, accurate hits at close to mid distances without overloading the operator with stadia lines or hold points that serve no meaningful use at these distances. In order to maximize the benefit of the stadia lines, in addition to mil markings there may also be sub mil subtensions (e.g. 0.25 mil, 0.33 mil, 0.50 mil, etc.) to aid in more accurate firing and range estimation.

The vertical stadia line, or holdover capabilities of the scope will permit the use of absolute (e.g. minutes/MOA, milliradian or mil, etc.) holds which can be used in a variety of firearms, loads, etc. They will have a further marking, either on the same side as the absolute holds or more preferably on the opposite side, of "relative" holds, or those set for a particular load and firearm at particular distances. These will apply when the scope is zeroed at a particular distance, for example 100 meters. The stadia lines which incorporate "absolute" holds (mils, moa, etc.) AND "relative" holds (for a given gun and cartridge at a particular range- or a class of guns and cartidges with a given zero distance) can be incorporated with this reticle design, OR it can be used independently. This is a novel and useful way to present data to the shooter in a variety of uses and conditions. This vertical stadia line incorporating relative and absolute holds may be used with this particular "Bracket" reticle, or it may be used in any other applicable or desired reticle.

A zero target can be provided with shorter range hold points for zeroing the optic and firearm in cases where longer range distance is not available. This would be aimed at ranges of 15-50 meters or equivalent yards. Many indoor shooting ranges are space-limited to 25-50 meters, which makes accurately zeroing the optic more difficult. This enables firearms and optics to be properly zeroed at shorter distances than expected, greater operating distances and gives operators confidence that they have properly zeroed their firearm and will be able to accurately place fire at ranges far in excess of the range at which the optic was zeroed.

A further advantage is that the reticle is not made for a single firearm/ammunition type, but can be tuned to any firearm and ammunition type with the aid of a conventional ballistic program.

The "close to mid distance" referred to above generally refers to close contact to 600 meters with targets of 3"-12", which are currently a significant challenge. Nothing precludes this type of reticle from being used out the effective limits of the any particular firearm and cartridge combination.

Offset Back Up Iron Sight (BUIS) Non 45° AMBI

The use of backup or other sight mounting device that follows the familiar 45° angle is fairly common. The issue this creates is that the firearm must be canted quite a bit (45°) for the sights to be properly oriented. This presents challenges when shouldering or firing the firearm. In other words to see the sights or other device properly, the gun must be canted quite severely which puts undue pressure on the wrist and puts the butt stock in an un-natural positions. The controls of the gun are in very unfamiliar areas to most shooters.

In accord with at least some aspects of the present concepts, a back up iron sight (BUIS) or other sight is mounted at an angle less than 45°, preferably at an angle between about 35°-44.5°, more preferably between about 22°-36°, even more preferably between about 10°-24°. These features minimizing the need to cant the firearm to properly orient the backup sight. These may also be used ambidextrously, and the same features can be used in offset iron sights or optic devices to maximize versatility and efficiency.

Body Armor and Carrier

Current body armor has advanced tremendously over the last decade or so with the global war on terror. One area of particular improvement is the use of rifle resistant "plates" which are hard armor (e.g., steel or ceramic) able to stop high power rifle rounds. The armor plates are worn in a device known as a "plate carrier" which is often a vest shaped garment.

One area that the plates fail to address is the risk to oblique or lateral rifle fire that hits the wearer of the plates behind the plate. As such, side armor plates have been introduced. The side plates are worn in a pouch that fits on the side of the plate carrier. This creates gaps in coverage that lack armor entirely, which creates great risk.

Additionally, the plate carriers often use bulky, stiff, and fixed shoulder straps that interfere with the "stock weld" or "cheek weld" of a "long gun" (e.g. assault or sniper rifle, submachine gun, grenade launcher, shotgun, etc.). In other words, the stock does not naturally and quickly rise to the cheek to allow the operator to optimally align the sights on target. The need to compensate for the interference of the shoulder straps further increases operator fatigue (e.g., the weight of the rifle is supported slightly further from the body) and causes their shooting accuracy to degrade, which has the potential to lower survivability in an engagement.

The conventional fixed shoulder strap, which uses effectively immovable and stiff material, often a heavy nylon webbing in multiple layers with Velcro and bulky connectors, can also dig into the operator's neck (e.g., a set of front and back ceramic Level IV plates can be 15-17 pounds, or more) which has the potential to, not only produce localized pain or discomfort, but also to interfere with blood and oxygen flow. These conventional straps also cause the plates to move with arm and shoulder movement, which causes further gaps over vital organs as the plate carrier moves with the arms and shoulder rather than staying in place over vital organs.

To address these deficiencies, disclosed herein are a number of enhancements that may be advantageously used in combination, but may also be used separately. A first feature in an embodiment of a plate carrier in accord with at least some aspects of the present concepts addresses the most serious issue, which is more effective coverage in the "60 degree frontal arc". This is the area that history has shown is most likely to draw fire in combat. Whereas conventional plate carriers and plates utilize an assemblage of a front plate and two side plates, as noted above, presenting gaps in this 60 degree frontal arc, the present plate carrier and plate utilize a single curved plate that "wraps" around the torso. This curved plate possesses an areal weight (pounds per square foot of material) of less than 4, more preferably less than 3, and most preferably less than 2, and may be formed from or comprise any conventional body armor materials, without limitation (e.g., ceramics, ceramic composites (e.g., Alumina Ceramic/Aramid), ultra-high-molecular-weight polyethylene (UHMWPE), Carbon Nano Tubes, titanium-steel alloy, etc.). The "wrap" can be measured by the gap between the rear most edges and the central portion of the plate, both figures being behind the armor. The gap should be at least 2", more preferably 3-4", even more preferably 4-6", and most preferably over 6". In some aspects, this gap could vary vertically. This enables the plate to offer seamless coverage to critical torso areas. The plate may be solid or hinged or layered, but is measured similarly in either case.

Put simply, given the dimensions above, if a plate is laid front-side down on a flat surface, there will be at least 2", and more preferably 3-4", or better yet 4-6", or most preferably 6"+ of space between the flat surface and the most distal rear portions of the armor plate. Stated differently, the greater this space, the greater the "wrap" around the torso and the less exposed or unprotected area, which is critical with flanking shots where the assailant is not directly in front of the wearer.

To address the issue of operator comfort and plate movement, the present concepts include the use of dynamic, padded materials in construction of shoulder straps as well as attachment devices between the shoulder strap of the pad and the plate or plate carrier. This will enable firearms to be used more effectively and also enable packs, other gear, and apparel to be worn more comfortably, thus lessening fatigue and increasing effectiveness and survivability. An example of the material would be the use of various thicknesses of neoprene, or similar material, which is both padded and dynamic. It may optionally be ventilated with vent holes in any shape for even better comfort and flexibility. Similarly, the dynamic straps can be made of neoprene as well, or other flexible material such as shock cord or straps, which may be combined in order to accommodate different materials and vest weights. In order to prevent plate carriers from "bottoming out" when very heavy, a non-dynamic (non-flexible) "bump strap" can be removably affixed to or integrated with the modified strap system in accord with the present concepts invention to provide a stop limit to the suspension travel afforded in the present design.

Helmet Strap

Current Chin Straps do not provide the necessary stability of ballistic helmets, especially when using night vision devices (NODS). In particular, lateral stability is lacking, which may allow the shifting of the helmet and the NODS away from the operator's eyes, potentially creating very negative results during night operations. This lateral instability is attributable to the conventional location of mounting points very close to one another. In accord with aspects of the present concepts, the mounting points are spaced apart greater than that of conventional systems so as to widen the mounting points to thereby enhance lateral stability.

In accord with this redesign, a helmet chin strap is provided with two or more "rear" mounting points spaced at least 3.5" apart. More preferably these mounting points will be 3.5"-5" apart, even more preferably 5"-6.5" apart, and most preferably 6.5"-8.5" or greater apart. "Rear" mounting points, as disclosed herein, refers to mounting points that are behind the wearer's ear opening or ear hole. This positioning provides not only lateral (side to side) stability, but also longitudinal (front to back) stability, which is particularly beneficial when a helmet is heavily loaded (e.g., NODS, battery packs, mounted hearing protection, etc.).

Boric Acid—Both and Treatment Areas Subject to CARBON and Other Fouling

The present concepts further include the use of boron, boric acid, and/or derivatives/variants thereof, as additives to firearm lubrication. In various aspects, this additive (or additives) may be in solution or in colloidal suspension. In testing performed by the inventor, these additives have been found to be beneficial for wear reduction and extreme pressure use. These additives have been found by the inventor to not only to add to the oxidative resistance and open air performance, but more critically to provide very significant anti-carbon and anti-fouling properties.

Testing by the inventor of boric acid and variants in various test blends of oil have shown that the addition of boric acid brings about unmatched anti-carbon and anti-fouling resistance and cleaning capability to treated materials. Parts that normally get fouled in testing have shown unprecedented resistance to fouling and staining from carbon and heavy metals as well as much improved (e.g., "wipe away") cleaning. Concentrations of 3-500 PPM (parts per million) have found to be helpful, and concentrations of 200-800 PPM have found to be more helpful, with concentrations of 700-2000 PPM being found to be even more helpful. Concentrations above 2000 PPM are most useful as well.

Materials can be treated with a blend containing boric acid to provide superior fouling resistance and better operation. This may include not only firearms and attachments such as suppressors but also the widest range of parts conventionally susceptible to fouling, such as exhaust, intake, or other mechanical parts.

Incidentally, these concepts may also be used in the case of open air lubrication where persistence and anti-oxidation are critical attributes such as, for example, motorcycle chains or bicycle chains. This concept is not limited to firearms.

The above pertain but are not envisioned as limited to lubricating, cleaning, and treatment oils of various types with a flash point over 300° F., more preferably 300° F.-450° F., even more preferably 425° F.-575° F., and most preferably 550° F.-630° F. With further advances, increases in flash point of 630° F.-650° F.+ are expected, and oils with flash points of 300° F. or below will benefit as well.

Additionally the use of a fast drying carrier (alcohol, as an example) may be used to deposit the boric acid in another manner where it will provide benefit independently of longer lasting carrier oils or other materials.

Optimally, base or carrier oils will use bio-derived elements with a high oleic acid content. The ratio of Monounsaturate (MUFA) to Polyunsaturate (PUFA) should be at least 3:1, and more preferably 3:1-5:1 or better. Optimally this ratio will be 5:1-9:1, with further advances possible as base stocks improve.

Magazine Release—Smith and Wesson M&P

In the current art on magazine release for the popular Smith and Wesson M&P semi-automatic pistol, there exists a problem with readily depressing the magazine release hereafter referred to as "mag catch". The problem is twofold and involves both the shape or angle of the contact surface to the finger or thumb and the amount of movement necessary to activate the release and drop or expel the empty or partially empty magazine in order to replace it with a full or loaded magazine in order to reload the pistol.

The angle of the magazine release, approximately 30° as compared to the orientation of the slide of the pistol, prevents even an operator with extra large (XL) hands using a "medium" grip insert on this pistol from releasing the magazine using the magazine release without shifting the grip of the firing hand. This reduces the effectiveness of the operator and slows the firing and reloading process. The interchangeable backstrap or grip insert is a feature designed to make the pistol more adaptable to a wide range of hand sizes. The problem with the angle of the magazine release becomes more acute with an operator with smaller hands or a larger grip insert. The operator must undesirably change their grip in order to drop the magazine because of this issue. This can lead to problems in competition, and can be fatal in duty or self-defense fire fights. This is important because this pistol is meant for duty and competition, among other uses. In accord with aspects of the present concepts, the angle of the magazine release user interface is dimensioned to more particularly correspond to user adaptations of the pistol (e.g., S&W M&P) grip utilizing different backstraps, so that the angle of the magazine release user interface or contact surface is parallel to the side of the slide surface, or nearly so (within 10° of slide), or within 10-15°, or even 15-25° of the slide surface. This will address part of the problem noted above.

The other aspect of the problem noted above is addressed, in accord with other aspects of the present concepts, by extending the side-to—side dimension, or width, of the magazine release. Currently this is 1.085"-1.156", measured from maximum outer surfaces-depending on whether the measurement is at the front or rear of the angled contact portion. In accord with these aspects, this dimension is extended by 0.010"-0.025", or preferably by 0.020-0.035", or even more preferably by 0.030"-0.050", and as much as 0.045-0.065", or greater than 0.065" up to 0.090". This can be up to 0.110" in changed dimension. When extended beyond this, the device is no longer suitable for duty use because of possible accidental magazine release, and may even negatively impact competition use. With these dimensions the release is easily accessed by the shooter without changing or adjusting grip, but it is not easily released by accident or incidental contact.

In the current art, the magazine release moves as much as 0.055"-0.065" before the magazine actually hits the point of "release". Extending the button or release, and changing the angle of the button relative to the orientation of the pistol body and slide overcome this problem.

Together these aspects of the present concepts address a key functional shortcoming with this pistol. The dimensions disclosed herein apply to the "M+P" series, both regular, compact, and all other variants in 9 mm and 0.40 S&W, and other caliber variants built on the same size frame.

This concept may also be applied to other pistols utilizing interchangeable backstraps in combination with conventional pistol magazine releases (e.g., Glock, FNH, certain models of HK not utilizing a paddle magazine release, etc.). Magazine releases in accord with these aspects of the present concepts are dimensioned to correspond to and adapt to user modifications of those particular pistols to adjust the orientation of and/or size of the contact area between the magazine release and the user's finger by, for example, modifying the angle of the magazine release user interface or contact surface, as noted above, with angles determined, for the particular pistol and backstrap combination, to address the two-fold problem noted above.

Pistol Sight

In accord with some aspects of the present concepts, a front sight may use a front sight post with, for example, a gold bead in combination with a self luminous insert (e.g., a tritium vial), a photo luminescent insert (e.g., activatable by exposure to light, such as a flashlight, or a fiber optic insert, with such inserts accentuating the front sight (i.e., aiming point). The combination of such inserts with the gold bead maximizes visibility and, correspondingly, engagement speed and accuracy across a range of light and target conditions. In various aspects, the gold bead itself may be round, hemispherical, or polygonal (e.g., diamond, triangular, square, etc.) although other shapes are possible.

Each of these embodiments and obvious variations thereof is contemplated as falling within the spirit and scope of the claimed invention, which is set forth in the following claims. Moreover, the present concepts expressly include any and all combinations and sub-combinations of the preceding elements and aspects that can be physically or dimensionally combined without compromising operability of the firearm.

In all aspects herein, all measurements provided are stated without any manufacturing, measurement errors, or tolerances taken into account and the measurements herein (e.g., "increasing the stroke by 3.75 inches") are to be read as incorporating conventional tolerances (e.g., +/−0.02 inches) and/or measurement errors (e.g., +/−0.02 inches). Additionally, the values provided herein (e.g., "increasing the stroke by 3.75 inches") may also be considered as a percentage different from conventional value (e.g., an improvement of 10% over a nominal TDP value).

Likewise, equivalent parts should be considered to be implied if not directly stated. For example, a piston AR "strike face" or tappet serves the same purpose in most respects as a gas key on a DI firearm, a mechanism for transferring gas energy into physical movement of the carrier, and stabilization as well.

What is claimed is:

1. A firearm with a lower receiver and bolt catch, the lower receiver comprising:

a first external wall portion that is on the left side of the firearm when a front of the lower receiver is facing forward, the rear of lower receiver is facing rearward, the bottom of the lower receiver is facing downward, and the firearm is in a firing position;

a second external wall portion that is on the right side of the firearm when a front of the lower receiver is facing forward, the rear of lower receiver is facing rearward, the bottom of the lower receiver is facing downward, and the firearm is in a firing position;

a bolt catch for preventing forward movement of the bolt when a firearm magazine is empty, wherein the bolt catch comprises:

a first external bolt catch portion that exits the first external wall portion of the receiver on the left side of the firearm;

a second external bolt catch portion that exits the second external wall portion of the receiver on the right side of the firearm; and an internal bolt catch portion within the lower receiver that connects the first external bolt catch portion and the second external bolt catch portion, wherein at least a first portion of the internal bolt catch portion extends in at least one of a rearward direction towards the rear of the receiver, or a downward direction towards the bottom of the lower receiver.

2. The lower receiver and bolt catch of claim 1, wherein the first portion extends in the rear direction towards the rear of the receiver.

3. The lower receiver and bolt catch of claim 1, wherein the first portion extends in the downward direction towards the bottom of the lower receiver.

4. The lower receiver and bolt catch of claim 1, wherein the first portion extends in both the rearward direction and the downward direction.

5. The lower receiver and bolt catch of claim 1, wherein the first portion of the internal bolt catch portion is within the lower receiver and extends in the rearward direction within the lower receiver towards the second external wall portion on the right side of the firearm near a magazine release button of the lower receiver.

6. The lower receiver and bolt catch of claim 1, wherein the first portion of the internal bolt catch portion is within the lower receiver and extends in the rearward direction within the lower receiver towards the second external wall portion on the right side of the firearm near a dust cover and a magazine release.

7. The lower receiver and bolt catch of claim 1, wherein the first external bolt catch portion further comprises a first lever surface, wherein the bolt catch is configured to release and allow forward movement of the bolt when the first lever surface is operated by a user.

8. The lower receiver and bolt catch of claim 7, wherein the second external bolt catch portion further comprises a control surface, wherein operation of the control surface activates the bolt catch.

9. The lower receiver and bolt catch of claim 1, wherein the bolt catch is pivotally mounted and configured to pivot about the lower receiver at a location proximal to the first external wall portion on the left side of the firearm.

10. A lower receiver usable with a firearm and configured to have a bolt catch pivotally mounted thereto, the lower receiver comprising:

a first external wall portion that is on the left side of the firearm when a front of the lower receiver is facing forward, the rear of lower receiver is facing rearward, the bottom of the lower receiver is facing downward, and the firearm is in a firing position;

a second external wall portion that is on the right side of the firearm when a front of the lower receiver is facing forward, the rear of lower receiver is facing rearward, the bottom of the lower receiver is facing downward, and the firearm is in a firing position;

a bolt catch mount configured to have a bolt catch pivotally mounted thereto, wherein the bolt catch mount is proximal to the first external wall;

a bolt catch passage configured to receive the bolt catch, wherein the bolt catch passage extends from a first bolt catch opening in the first external wall at the left side of the firearm to a second bolt catch opening in the second external wall at the right side of the firearm, wherein the second bolt catch opening is located closer to the rear of the lower receiver than the first bolt catch opening.

11. The lower receiver of claim 10, wherein the second opening in the second external wall portion on the right side of the firearm is near a magazine release button of the lower receiver.

12. The lower receiver and bolt catch of claim 10, wherein the second opening in the second external wall portion on the right side of the firearm is near a dust cover and a magazine release.

13. A bolt catch usable with a lower receiver of a firearm, the bolt catch comprising:

a first external bolt catch portion that is configured to exit the lower receiver at a first external wall portion that is on the left side of the firearm when a front of the lower receiver is facing forward, the rear of lower receiver is facing rearward, the bottom of the lower receiver is facing downward, and the firearm is in a firing position;

a second external bolt catch portion that is configured to exit the lower receiver at a second a second external wall portion that is on the right side of the firearm when a front of the lower receiver is facing forward, the rear of lower receiver is facing rearward, the bottom of the lower receiver is facing downward, and the firearm is in a firing position;

an internal portion configured to be located within the lower receiver that connects the first external bolt catch portion and the second external bolt catch portion, wherein at least a first portion of the internal portion is configured to extend in at least one of a rearward direction towards the rear of the receiver or a downward direction towards the bottom of the lower receiver when the bolt catch is mounted to the lower receiver.

14. The bolt catch of claim 13, wherein the first portion is configured to extend in the rear direction towards the rear of the receiver when the bolt catch is mounted to the lower receiver.

15. The bolt catch of claim 13, wherein the first portion is configured to extend in the downward direction towards the bottom of the lower receiver when the bolt catch is mounted to the lower receiver.

16. The bolt catch of claim 13, wherein the first portion is configured to extend in both the rearward direction and the downward direction when the bolt catch is mounted to the lower receiver.

17. The bolt catch of claim 13, wherein the first external bolt catch portion further comprises a first lever surface, wherein the bolt catch is configured to release and allow forward movement of a bolt when the first lever surface is operated by a user.

18. The bolt catch of claim 17, wherein the second external bolt catch portion further comprises a control surface, wherein operation of the control surface activates the bolt catch.

19. The lower receiver and bolt catch of claim 1, wherein the bolt catch is pivotally mounted and configured to pivot about the lower receiver at a location proximal to the first external portion on the left side of the firearm.

* * * * *